US006892043B2

(12) United States Patent
Hayashi et al.

(10) Patent No.: US 6,892,043 B2
(45) Date of Patent: May 10, 2005

(54) METHOD AND DEVICE FOR PACING AN IMAGE READER AT A CONSTANT SCANNING SPEED

(75) Inventors: Eiichi Hayashi, Saitama (JP); Kazutsugu Ogata, Saitama (JP); Yuichi Ishiyama, Saitama (JP); Osamu Shinohara, Saitama (JP); Satoshi Mikajiri, Saitama (JP)

(73) Assignee: Fujinon Corporation (JP)

( * ) Notice: Subject to any disclaimer, the term of this patent is extended or adjusted under 35 U.S.C. 154(b) by 0 days.

(21) Appl. No.: 10/616,318

(22) Filed: Jul. 9, 2003

(65) Prior Publication Data

US 2004/0047654 A1 Mar. 11, 2004

(30) Foreign Application Priority Data

Jul. 10, 2002 (JP) ..... 2002-200838

(51) Int. Cl.[7] ..... G03G 15/30
(52) U.S. Cl. ..... 399/208; 399/211; 399/213
(58) Field of Search ..... 318/254, 439; 323/246, 320; 358/410, 412, 413, 474, 486; 399/51, 177, 208, 211, 213

(56) References Cited

U.S. PATENT DOCUMENTS 5,847,521 A * 12/1998 Morikawa et al. ..... 318/254
6,009,292 A * 12/1999 Jinbo et al. ..... 399/208

FOREIGN PATENT DOCUMENTS

JP 10257252 9/1998

* cited by examiner

*Primary Examiner*—Hoang Ngo
(74) *Attorney, Agent, or Firm*—Price, Heneveld, Cooper, DeWitt & Litton

(57) ABSTRACT

Speed fluctuations at a motor supplied with a two-phase current is reduced by changing the current value ratio at each phase in the drive current to feed a drive motor for an image reader to allow a light source lamp to move, free from speed fluctuations, to scan at a constant scanning speed. The drive motor is supplied with current different in value at each phase from constant current drive circuits, which, in one embodiment, are connected with current regulating variable resistors. An acceleration detector is fixed at the drive motor to detect acceleration fluctuations in rotation of the drive motor to detect speed fluctuations. In some embodiments, thermal control of the motor drive circuit is provided and vibration proofing to isolate the light receptor from the drive motor.

42 Claims, 26 Drawing Sheets copy at magnification rate of 200%

| | | motor | | | |
|---|---|---|---|---|---|
| | | M4 | M1 | M3 | M2 |
| | | wow and flutter [mV] | | | |
| control substrate | current value ratio (1-phase A/phase B) [%] | 5 | 26 | 35 | 52 |
| #10 | 11.9% | 7.972 | 3.038 | 6.341 | 4.502 |
| #11 | 6.9% | 3.632 | 0.698 | 1.257 | 0.927 |
| #12 | 4.7% | 1.453 | 0.29 | 1.124 | 2.471 |
| #15 | 0.6% | 2.976 | 1.971 | 4.674 | 3.641 |
| #13 | -7.4% | 6.748 | 3.779 | 10.496 | 10.968 |
| #14 | -8.7% | 7.549 | 4.356 | 8.674 | 10.742 |

Fig. 8 copy at magnification rate of 400%

| | | motor | | | |
|---|---|---|---|---|---|
| | | M4 | M1 | M3 | M2 |
| | | wow and flutter [mV] | | | |
| control substrate | current value ratio (1-phase A/phase B) [%] | 5 | 26 | 35 | 52 |
| #10 | 11.9% | 11.021 | 5.513 | 10.076 | 6.654 |
| #11 | 6.9% | 5.409 | 2.005 | 3.894 | 2.178 |
| #12 | 4.7% | 2.224 | 0.438 | 1.553 | 3.897 |
| #15 | 0.6% | 3.59 | 3.623 | 6.359 | 7.969 |
| #13 | -7.4% | 12.746 | 9.003 | 16.521 | 19.195 |
| #14 | -8.7% | 13.969 | 8.584 | 7.042 | 20.021 |

Fig. 9

METHOD AND DEVICE FOR PACING AN IMAGE READER AT A CONSTANT SCANNING SPEED

BACKGROUND OF THE INVENTION

1. Field of the Invention

The present invention relates to a method and a device for pacing an image reader at a constant scanning speed, to stabilize the speed of a drive motor in an image reader, e.g. such as a copying machine, scanner or the like, thereby keeping a constant speed in reading an image.

2. Description of the Related Art

An image reader, such as a copying machine, scanner, etc., used to read and process image data on an original of a paper sheet etc. comprises a light source lamp such as a fluorescent lamp to irradiate light beams on an original and a light receptor with a photoelectric converter device such as CCD (Charge-Coupled Device) to receive the reflected light. The image reader for stationary original such as described in Japanese Laid-Open Patent Application No. 1998-257252 irradiates light beams onto an original on a platen glass, with a moving light source lamp. Then, a reflector or the like is arranged to guide the reflected light beams to the light receptor and is also adapted to travel along the original together with the light source lamp, as required to keep constant the optical path length from the original to the light receptor, without being affected by the change in position of the irradiating light beams on the original.

In recent years, such image data read out by this kind of image reader are not only outputted on a paper sheet but transferred into personal computers for various uses where higher image quality and more faithful reproducibility than ever before are required, based on more precisely obtained image data.

To obtain more precise image data, various ideas have been tried including structures to keep a drive motor working at a constant speed, preventing the vibration of the drive motor from being transmitted to the light source lamp, to thereby keep the light source lamp traveling at a constant speed.

On the other hand, the drive motor has a little irregularity in rotation by its own nature, causing speed fluctuations to result also in irregularity in traveling speed of the light source lamp, sometimes failing to obtain image data precisely enough to satisfy the requirements for high image quality. This type of speed fluctuations, caused by the characteristics of the drive motor itself, cannot always be eliminated by a known structure where an inertia spindle is conventionally used to smooth the rotation.

SUMMARY OF THE INVENTION

To eliminate such speed fluctuations, the present inventors tried various efforts, noticed the characteristics of the drive motor, and achieved a certain result in elimination of speed fluctuations by adjusting the supply current. The object of the present invention is to offer a method and a device for pacing an image reader at a constant scanning speed to obtain precise image data by minimizing speed fluctuations at the drive motor in the image reader to assure the light source lamp travels at a constant speed.

The above objective is technically attained by the method for pacing an image reader at a constant scanning speed according to the present invention characterized in that an image reader comprises: a light source lamp traveling along an original on a platen glass, to scan the original with light beams irradiated from the light source lamp, to read an image formed on the original by detecting light beams reflected from the original and guiding the light beams to the light receptor; and a drive motor supplied with a two-phase current for the light source lamp to travel, making difference in current value at each phase of the two-phase current.

The present inventors discovered that speed fluctuations at a drive motor, such as a stepping motor supplied with a two-phase current, are changed by making difference in current value at each phase of the two-phase current and also discovered the fact that speed fluctuations at the drive motor are minimized by selecting an appropriate current value ratio between the two phases. Then, the appropriate difference in current value to minimize speed fluctuations at the drive motor used for the image reader can be determined for the light source lamp to scan at a constant speed, based on the determined result, to obtain image data faithful to the image on the original.

Speed fluctuations in drive motor may depend on a number of factors, including the number of turns in winding around a rotor, change in temperature at the motor or its drive circuit, etc.

The method for pacing an image reader at a constant scanning speed according to the present invention is characterized in that either one current value of the two-phase current is varied to make a difference in current value between the two phases.

A drive motor is installed in an image reader, supplied with current at an equal value at each phases, while changing the current value at one of the phases to set a value to minimize speed fluctuations at the drive motor. Speed fluctuations at the drive motor depend on the difference among individual drive motors. Therefore, a drive motor can be adjusted, as installed in an image reader, to make it easy for the drive motor to pace at a constant speed, by making the current value adjustable at each phase in accordance with the respective drive motors.

Then, the method for pacing an image reader at a constant scanning speed according to the present invention is characterized in that speed fluctuations at the drive motor must be detected to pace the drive motor at a constant speed and the difference in current value at each phase is based on the detected result.

Then, the method for pacing an image reader at a constant scanning speed according to the present invention is characterized in that a tentative scan is tried to detect speed fluctuations at the drive motor. During the tentative scan, adjustments are made to the difference in current value at each phase of the two-phase current based on the detected results before making a definitive scan to obtain image data.

Speed fluctuations at drive motor may be caused also by change in temperature at drive motor or its drive circuit. For example, an image reader may change its speed, after long duration operation, even if it was constant at the beginning. Then, a tentative scan may be tried to adjust a current value while detecting speed fluctuations, before a definitive scan to obtain an image faithful to an original.

Then, the method for pacing an image reader at a constant scanning speed according to the present invention is characterized in that the light source lamp travels to detect its speed fluctuations to make difference in current value at each phase of the two-phase current, based on the detected result.

Speed fluctuations at drive motor are determined on detecting speed fluctuations when a light source lamp travels. The light source lamp must travel at a constant speed in order to obtain image data faithful to an original. Therefore, the traveling speed fluctuations should be determined to adjust the current value, based on the determined results. More faithful image data can be obtained, due to direct detection of the traveling speed fluctuations when the light source lamp travels.

Then, the method for pacing an image reader at a constant scanning speed according to the present invention is characterized in that a tentative scan is tried to detect speed fluctuations when the light source travels during the tentative scan and to adjust to make difference in current value at each phase of the two-phase current, based on the detected result, before a definitive scan to obtain image data.

To cope with drive motor speed fluctuations caused by change in temperature at drive motor or its drive circuit, a tentative scan is tried before a definitive scan, while adjusting the current value by detecting the light source lamp speed fluctuations, thus always enabling a definitive scan to obtain image data faithful to an original.

Then, the device for pacing an image reader at a constant scanning speed according to the present invention is characterized in that an image reader comprises: a light source lamp traveling along an original on a platen glass, while irradiating light beams to scan the original, detecting light beams reflected from the original to guide the light beams to the light receptor to read out an image formed on the original; a drive motor supplied with two-phase current for the light source lamp to travel; and a drive circuit to make difference in current value at each phase of the two-phase current.

As mentioned above, a drive motor can work at a constant speed, supplied with a two-phase current with difference in current value or changing the current value ratio, thus allowing a light source lamp to travel at a constant speed during a scan, to obtain image data faithful to an image on an original.

Then, the device for pacing an image reader at a constant scanning speed according to the present invention is characterized in that a motor current detecting resistor at least at either phase of the drive circuit is a variable resistor and the current value is adjusted at least at either of the two-phase current for the drive circuit to work by changing resistance value at the variable resistor.

The current value can be changed at least at either phase by adjusting a resistance value at the above variable resistor, when supplied to a drive motor, thus allowing the two-phase current to have a different current value ratio which can be adjusted to be as large as needed. As a result, the drive motor can be kept rotating at a constant speed, as installed in an image reader.

Then, the device for pacing an image reader at a constant scanning speed according to the present invention is characterized in that the two-phase current for the drive motor to work is adjusted in current value at least at either phase by changing the motor current value setting reference voltage supplied on a phase-by-phase basis from a control circuit to the drive circuit.

In other words, the current value varies at each phase for the drive motor to work by variation in motor current value setting reference voltage.

Then, the device for pacing an image reader at a constant scanning speed according to the present invention is characterized in that one current value setting reference voltage supplied to a drive circuit feeding from a control circuit to the respective phases of the drive motor is inputted at either reference voltage input terminal, as it is, while a voltage generated by dividing thus supplied reference voltage at a variable resistor is inputted at the other terminal, in order to adjust in current value at least at either phase of the two-phase current for the drive motor to work by changing resistance value at the variable resistor.

In other words, to make difference in value of voltage fed to the respective phases, a control circuit inputs a reference voltage to one of the drive circuits corresponding to the respective phases, while inputting a partial potential of the reference voltage generated via a variable resistor at the other drive circuit. Output voltage at the drive circuit varies with change in resistance value at the variable resistor, making difference from the voltage value of the output voltage at the drive circuit where the reference voltage has been inputted. As a result, it makes difference in current value at each phase as controlled by each drive circuit.

Then, the device for pacing an image reader at a constant scanning speed according to the present invention is characterized in that it comprises a speed fluctuations detecting means to detect speed fluctuations at the drive motor to make difference in current value at each phase of the two-phase current, based on the result detected by the speed fluctuations detecting means.

Speed fluctuations at drive motor are detected by speed fluctuations detecting means such as acceleration pickup. Based on the detected result, the two-phase current is adjusted in current value at either phase to pace the drive motor at a constant speed.

Then, the device for pacing an image reader at a constant scanning speed according to the present invention is characterized in that a tentative scan is tried to detect speed fluctuations at the drive motor and to adjust to make difference in current value at each phase of the two-phase current, based on the detected result, before a definitive scan to obtain image data.

Speed fluctuations at the drive motor are detected, before obtaining image data of an original, to adjust the current value to feed the drive motor and vary the magnitude of current value at each phase, in order to cope with any speed fluctuations at the drive motor due to change in temperature.

Then, the device for pacing an image reader at a constant scanning speed according to the present invention is characterized in that a tentative scan is tried, with a test chart, placed somewhere on the platen glass or on the underside of the top plate of the housing to avoid any harm in obtaining image data of an original, to obtain image data for measurement from the test chart, to detect speed fluctuations at the light source lamp from the image data for measurement, and to adjust, based on the detected result, to make difference in current value at each phase of the two-phase current, before a definitive scan to obtain image data.

Speed fluctuations at the light source lamp are detected from image information of image data obtained from the test chart during a tentative scan. The value of supply current to the drive motor is adjusted, based on the detected result. The definitive scan after adjustment allows the light source lamp to travel at a constant speed to give image data faithful to the original.

Then, the device for pacing an image reader at a constant scanning speed according to the present invention is characterized in that the drive circuit of the drive motor is installed on a circuit substrate housed inside a cover to cover the light receptor and it comprises cooling means to cool the circuit substrate.

Change in temperature at the drive motor or drive circuit should preferably be controlled for the drive motor to work at a constant speed. Then, rise in temperature is controlled by the cooling means at the circuit substrate where the drive circuit is integrated. The cooling means may involve a cooling port opened at the cover to move the air inside the cover or an opening formed on the cover at a part facing the circuit substrate to keep the circuit substrate in touch with the air outside the cover or also a fan to spray cooling air for positive air-cooling.

Then, the device for pacing an image reader at a constant scanning speed according to the present invention is characterized in that it comprises vibration proofing means to prevent vibration at the drive motor from being transmitted to the light receptor.

Micro vibration may occur even at a drive motor working at a constant speed. This micro vibration, transmitted to the light receptor, may change the positions of light beams including image data of an original and the relative position of the light receptor, likely to result in deformation of loaded image data. Then, transmission of vibration to the light receptor is controlled by the vibration proofing means to keep the light beams constantly incident onto the light receptor. Vibration proofing means may involve a fixing screw to fix the cover to cover the light receptor to catch the reflected light beams, fitted in a bushing made of elastic material such as vibration proofing rubber, a structure in which vibration generated at the drive motor is attenuated by a spindle arranged at some midpoint in transmission path to the photoelectric converter device, a structure in which a fixing tongue, notched at both sides, projecting from the cover to fix the fixing screw is formed at the tip of a supporting arm oscillating as subjected to vibration, etc.

These and other features, objects and advantages of the present invention will become apparent upon reading the following description thereof together with reference to the accompanying drawings.

BRIEF DESCRIPTION OF THE DRAWINGS

FIG. 8 is a table of data relating to speed fluctuations obtained from a motor driven by a speed stabilizer according to the present invention, with a magnification rate of 200% at the image reader;

FIG. 9 is a table of data relating to speed fluctuations obtained from a motor driven by a speed stabilizer according to the present invention, with a magnification rate of 400% at the image reader;

DETAILED DESCRIPTION OF THE EMBODIMENTS

The method and device for pacing an image reader at a constant scanning speed according to the present invention will be specifically explained here below, based on the illustrated preferred embodiments.

Figure 1:
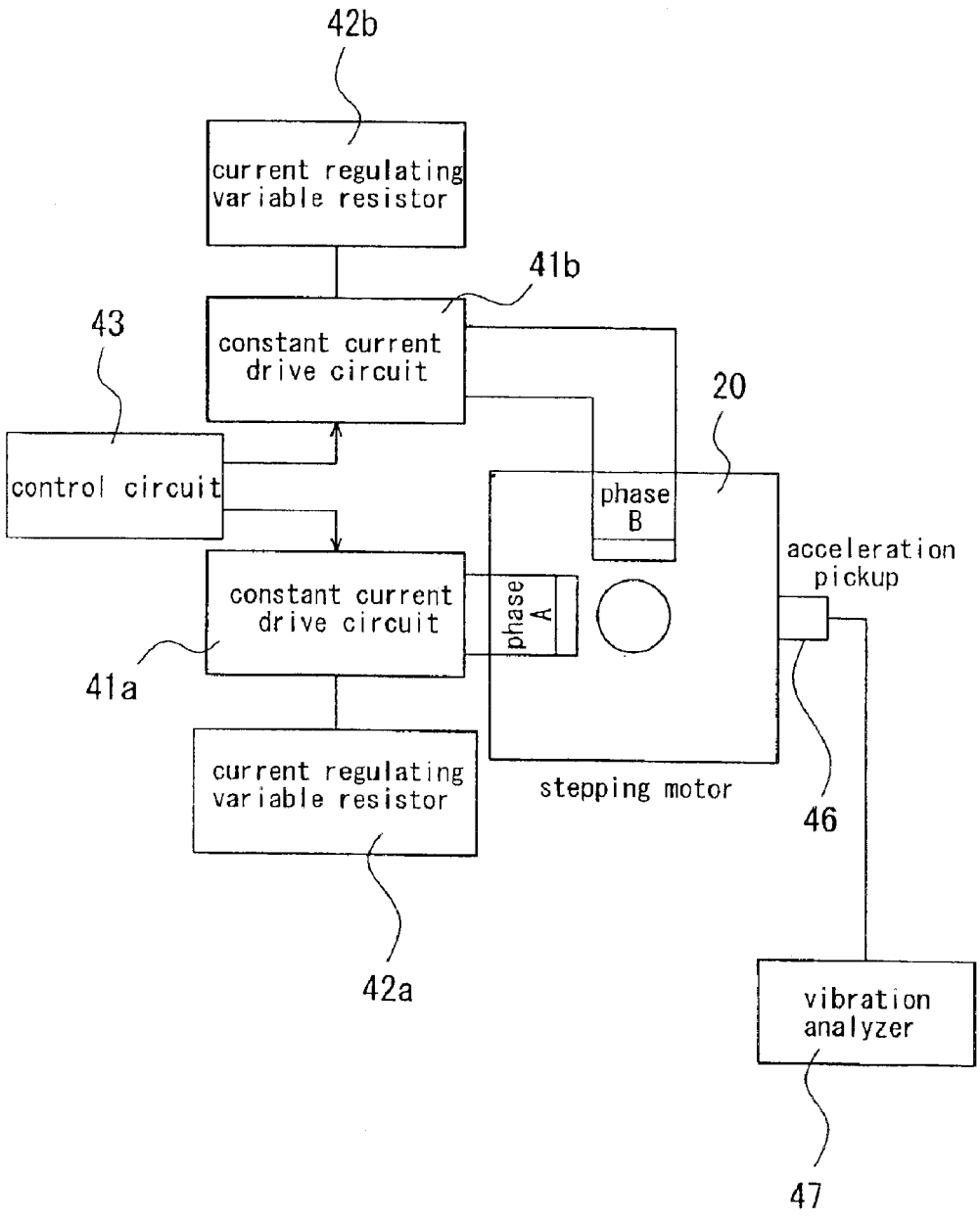
FIG. 1 is a block electrical circuit diagram roughly showing the construction of the driving system of the drive motor according to a speed stabilizer appropriate to realize the method for pacing an image reader at a constant scanning speed according to the present invention.
Figure 5:
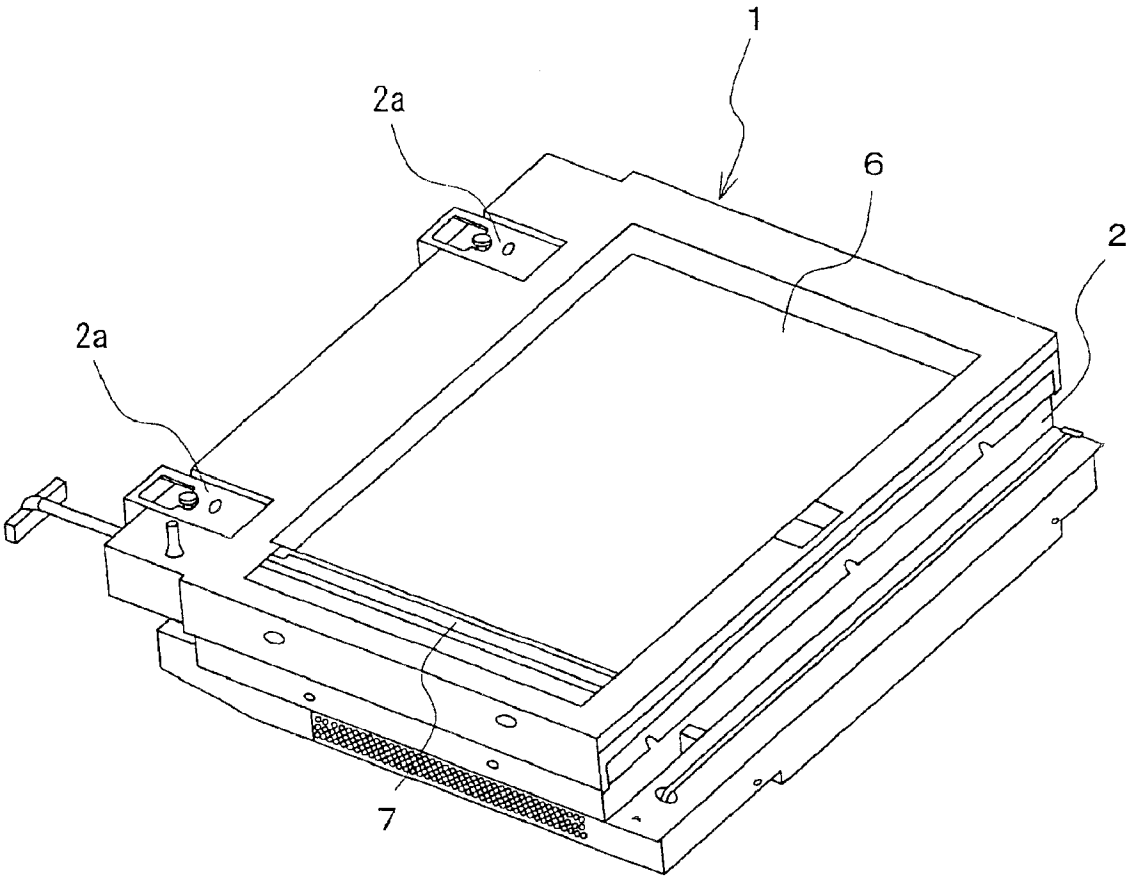
FIG. 5 is a fragmentary schematic perspective view of an image reader appropriate to comprise a speed stabilizer according to the present invention.
Figure 6:
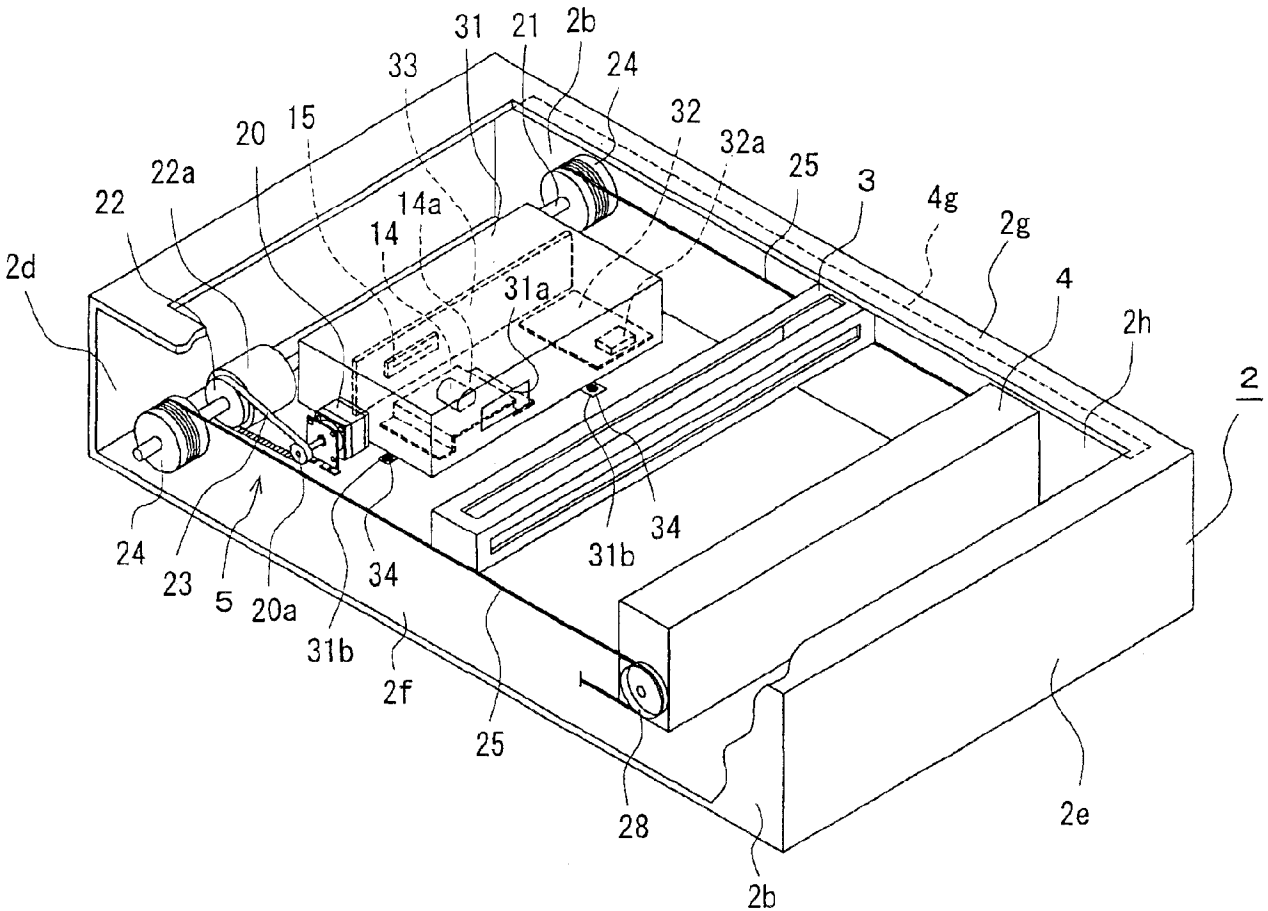
FIG. 6 is a fragmentary perspective view showing the schematic construction of an image reader appropriate to comprise a speed stabilizer according to the present invention.
Figure 7:
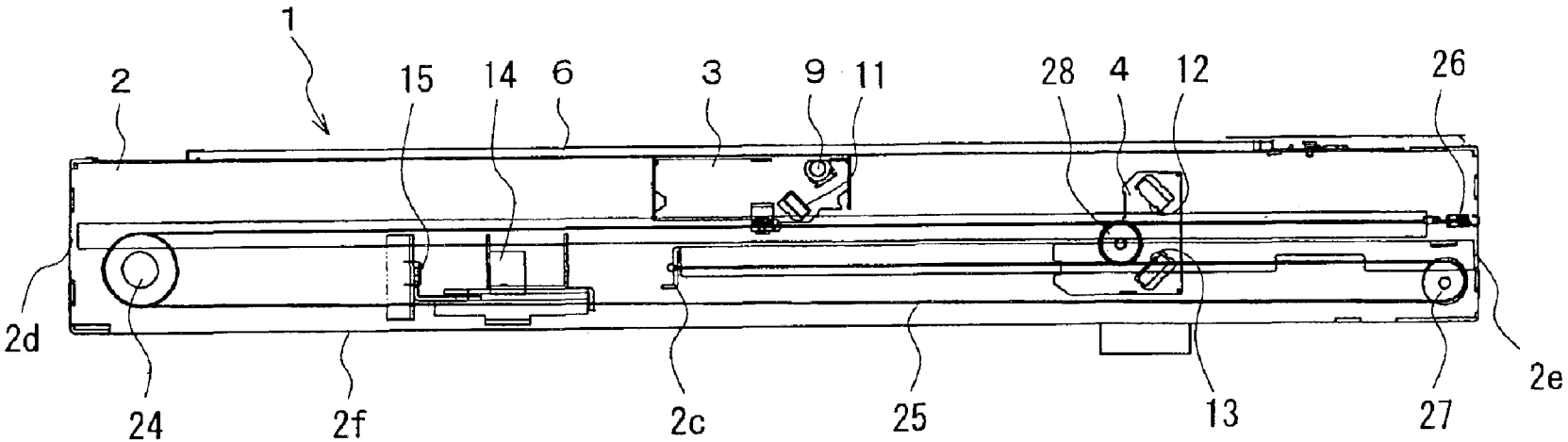
FIG. 7 is a longitudinal cross-sectional view showing the schematic construction of an image reader appropriate to comprise a speed stabilizer according to the present invention.

FIG. 1 is a schematic block diagram to show the drive system for a drive motor 20 of image reader 1 which includes a speed stabilizer using the speed stabilizing method of this invention. FIG. 5 is a perspective view roughly showing the main body of image reader 1 and FIGS. 6 and 7 show the construction of image reader 1. Image reader 1 comprises full rate carriage 3, half rate carriage 4, and driving mechanism 5 for the carriages housed in housing 2. Main platen glass 6 and sub platen glass 7 are removably fixed so as to cover the upper opening of housing 2 of image reader 1. Then, this image reader 1 is used not only fixing an original on main platen glass 6 while moving a light source along the original but also for feeding an original with a light source fixed in a certain position using sub platen glass 7, both to obtain image data. Housing 2 has, on its upper side back, hinge seat 2*a* to support lid 3, allowing it to be opened and closed.

As shown in FIG. 6, housing 2 has, inside its longitudinal wall 2*b*, a guide plate (not illustrated) to guide the full rate carriage 3 and half rate carriage 4 to move longitudinally in housing 2.

FIG. 7 is a sectional view of image reader 1 longitudinally cut along a vertical plane. The full rate carriage 3 carries light source lamp 9 to illuminate an original and first reflector 11 to reflect the reflected light beams to half rate carriage 4. Half rate carriage 4 has second and third reflectors 12 and 13 to reflect light beams, incident from first reflector 11, one after another to transmit them through image forming lens 14 provided at the bottom of housing 2, to make them incident on photoelectric converter device 15, such as a CCD. Full rate carriage 3 can move all over main platen glass 6, as required to irradiate light beams all over an original to obtain image data of the original. The optical path, formed by first, second, and third reflectors 11, 12 and 13 to guide reflected light beams from the original to the photoelectric converter device 15, must have a constant length according to this movement of full rate carriage 3. To that effect, half rate carriage 4 moves only half as much as full rate carriage 3, as synchronized with full rate carriage 3 to keep the optical path length constant.

Carriages 3 and 4 are driven by drive motor 20 fixed in the vicinity of one of the walls 2*d* of housing 2 in the direction in which carriages 3 and 4 move. Inertia spindle 22*a* with driven pulley 22 fixed at a part of it is fitted around drive axis 21 supported between walls 2*b* and the spindle. Belt 23 is looped over driving pulley 20*a* fitted around an output axis of the drive motor 20 and over driven pulley 22 to transmit the output rotation of drive motor 20 to drive axis 21.

Driving pulleys 24 are fitted at both ends of drive axis 21 and drive wire 25 is wound around the driving pulleys 24. As shown in FIG. 7, an end of this drive wire 25 is hooked at wall 2*e* on the side opposite to the drive motor 20 by means of pulling coil spring 26. Then, this wall 2*e* rotatably supports guide pulley 27. Half rate carriage 4 coaxially and rotatably supports at both sides a pair of intermediate pulleys 28*a* and 28*b*. Drive wire 25 is wound from an end hooked to the pulling coil spring 26 over intermediate pulley 28*a* or one of the intermediate pulleys 28 to be guided to the guide pulley 27. It is wound around this guide pulley 27 to be guided to the drive pulley 24 and turned as many times as needed around drive pulley 24. It is guided from drive pulley 24 to intermediate pulley 28*b* or the other one of the intermediate pulleys 28, with full rate carriage 3 linked on the way. It is wound around intermediate pulley 28*b* to be guided in the direction toward drive pulley 24, while hooked at the end to bracket 2*c* fixed almost at the center of wall 2*b* of housing 2. Then, this drive mechanism 5 is a publicly known mechanism in this type of image reader 1 and makes half rate carriage 4 move half as much as full rate carriage 3 in accordance with movement of full rate carriage 3 and half rate carriage 4.

The above image forming lens 14 and photoelectric converter device 15 are housed, as shown in FIG. 6, in lens cover 31 to cover a part of bottom plate 2*f* of housing 2. The lens cover 31 has, at a part faced with image forming lens 14, opening 31*a* to pass light beams reflected from the third reflector 13 (FIG. 7). The lens cover 31 contains a drive circuit substrate 32 equipped with drive IC 32*a* working as a drive circuit to control the drive motor 20 and CCD circuit substrate 33 equipped with a CCD working as the above photoelectric converter device 15, in addition to image forming lens 14. The above image forming lens 14 is carried on support plate 14*a* attached on bottom plate 2*f* to be adjustable in position relative to support plate 14*a,* to make the attaching position adjustable to assure incidence of light beams reflected from third reflector 13 on image forming lens 14.

As shown in FIG. 1, a stepping motor driven by a two phase current is used for drive motor 20. Phases A and B are both supplied with constant current from constant current drive circuits 41*a* and 41*b*. These constant current drive circuits 41*a* and 41*b* are connected with current regulating variable resistors 42*a* and 42*b* respectively to allow supply current from constant current drive circuits 41*a* and 41*b* to be adjusted in value. A current regulating variable resistor 42 may be connected with either one of the constant current drive circuits 41 to allow only supply current from the same constant current drive circuit 41 to be adjusted in value. Then, output signals from control circuit 43 are inputted to constant current drive circuits 41*a* and 42*b* to control constant current drive circuits 41*a* and 41*b*, based on drive information indicated by image reader 1.

Figure 2:
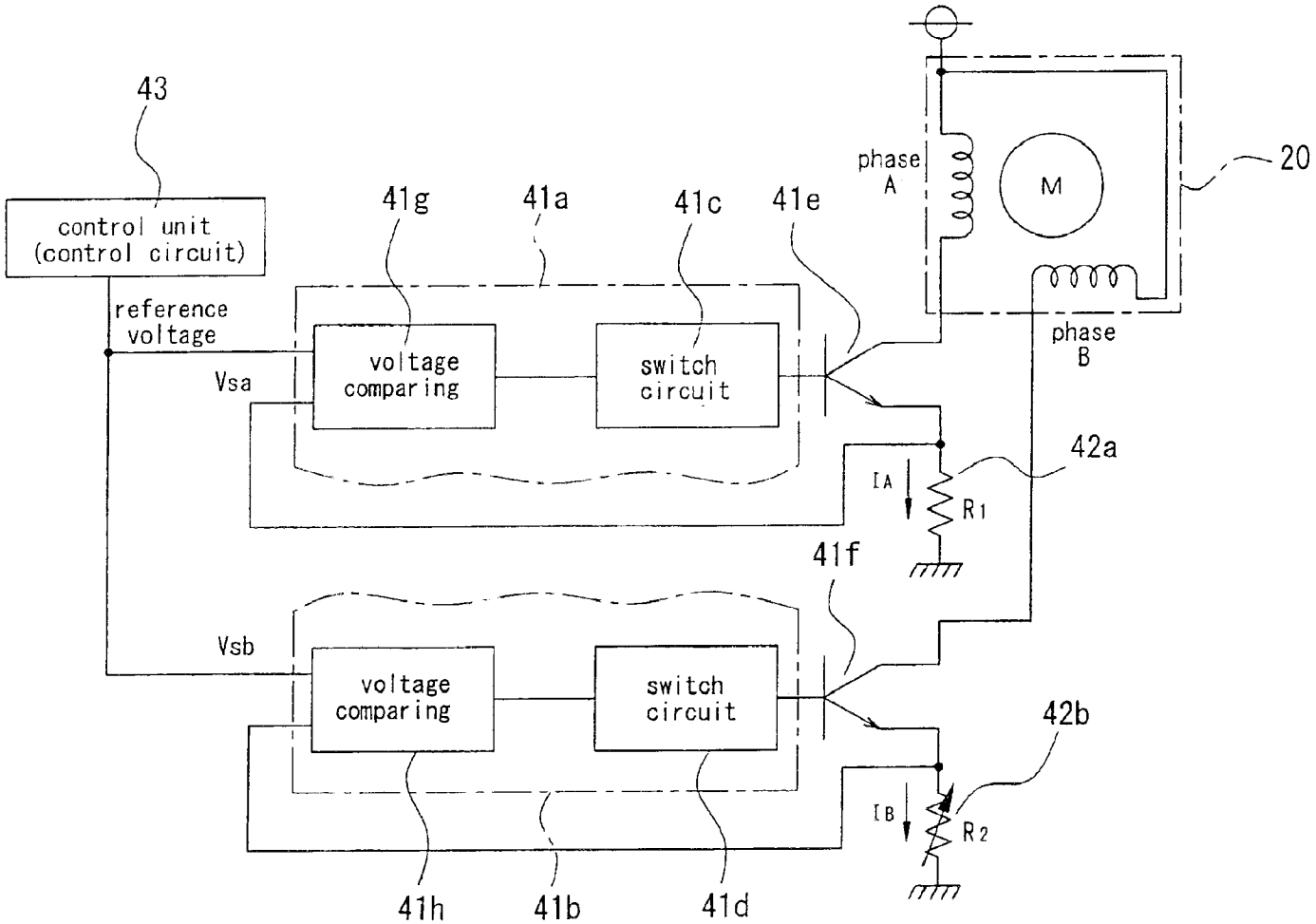
FIG. 2 is an electrical circuit diagram, partly in block and schematic form, illustrating a first embodiment, as shown in FIG. 1.

More specifically, as shown in FIG. 2, bases of switching transistors 41*e* and 41*f* are connected on the output side of switch circuits 41*c* and 41*d* for constant current drive circuits 41*a* and 41*b*, while the above current regulating variable resistors 42*a* and 42*b* are connected with emitters for these switching transistors 41*e* and 41*f*. These current regulating variable resistors 42*a* and 42*b* are supplied with current through coils of phases A and B of drive motor 20 to generate, at both ends of these current regulating variable resistors 42*a* and 42*b,* a voltage proportional to the current value. Such voltages are inputted to voltage comparing circuits 41*g* and 41*h* of constant current drive circuits 41*a* and 41*b* to compare drive voltages at each phase of drive motor 20. In other words, drive motor 20 can be adjusted in current value at phase B by adjusting resistance values of the above variable resistor 41*b*. Resistors 42*a* and 42*b* are both explained as variable resistors in this embodiment but variable resistor 42*b* may be the only one.

Figure 3:
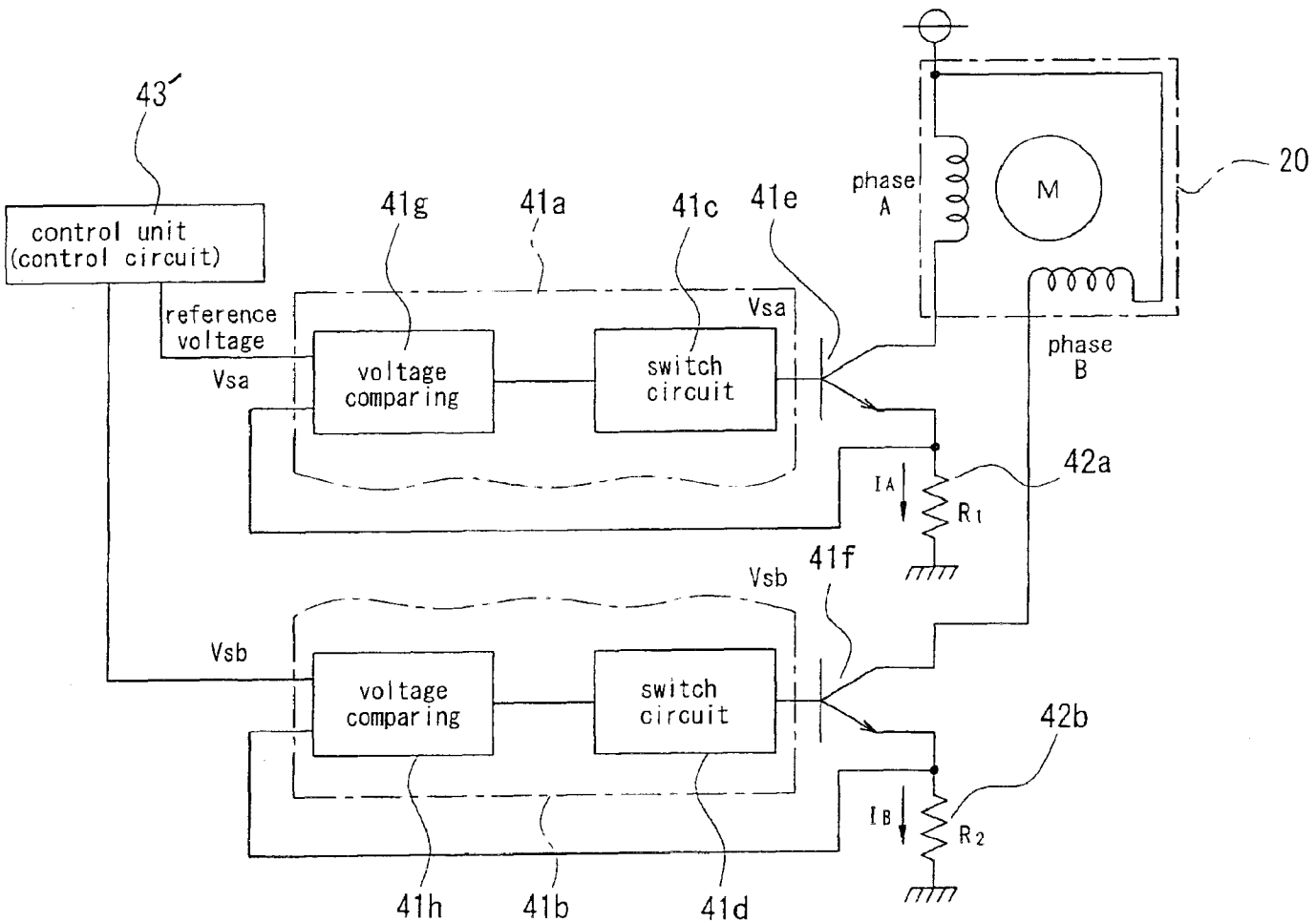
FIG. 3 is an electrical circuit diagram, partly in block and schematic form, illustrating a second embodiment, as shown in FIG. 1.

Drive motor 20 can be supplied with different currents at each of phases A and B, by making difference between voltages Vsa and Vsb to feed constant current drive circuits 41*a* and 41*b* from control unit 43. As shown in FIG. 3, a control circuit 43' supplies constant current drive circuits 41*a* and 41*b* respectively with voltages Vsa and Vsb separately, making difference in value between these voltages to control collector current of the above transistors 41*e* and 41*f*, to vary the current value to feed each phase of drive motor 20. Then, the above current regulating variable resistors 42*a* and 42*b* can be both fixed resistors.

Figure 4:
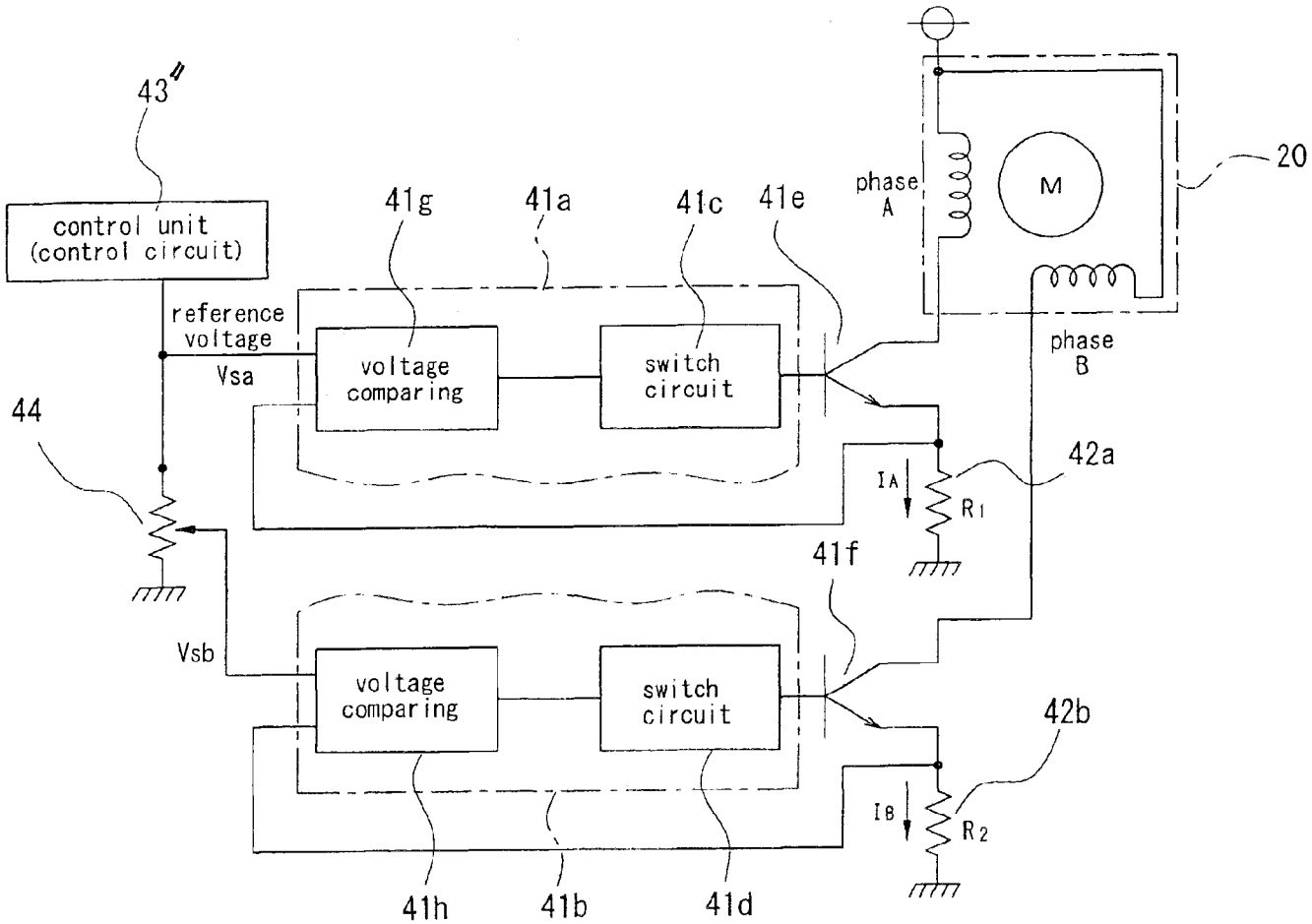
FIG. 4 is an electrical circuit diagram, partly in block and schematic form, illustrating a third embodiment, as shown in FIG. 1.

As shown in FIG. 4, a control unit 43' may feed constant current drive circuit 41*a* with reference voltage and constant current drive circuit 41*b* via a resistive potential divider 44 to supply constant current drive circuits 41*a* and 41*b* with voltages Vsa and Vsb respectively to provide the desired difference in current to feed at each phase of drive motor 20. In such case, the above current regulating variable resistors 42*a* and 42*b* may be equal and constant in resistance value.

Drive motor 20 has acceleration pickup 46 (FIG. 1) to detect speed fluctuations and to detect acceleration of the rotation of drive motor 20. Output signals of this acceleration pickup 46 are inputted to vibration analyzer 47 to detect acceleration by speed fluctuations of drive motor 20.

Speed fluctuations for different drive motors 20 have been measured by the circuit as shown in FIG. 1, resulting in tables of FIGS. 8 and 9. Image data of an original are obtained by image reader 1, as copied at a magnification rate of 200% in FIG. 8, while 400% in FIG. 8 and also as scanned at some different speeds. Then, current value ratios at phases A and B are set by exchanging 6 control substrates #10 to 15. As for these control substrates #10 to 15, current value ratios at phases A and B, represented as percentage current value ratios of (1-phase A/phase B), are 11.9%, 6.9%, 4.7%, 0.6%, −7.4%, −8.7%. Then, 4 types of drive motors 20 M1 to M4 different in wow and flutter values are used as drive motor 20, and the wow and flutter values measured by a specific wow and flutter measurement device are 26 mV, 52 mV, 35 mV, 5 mV.

Figure 10:
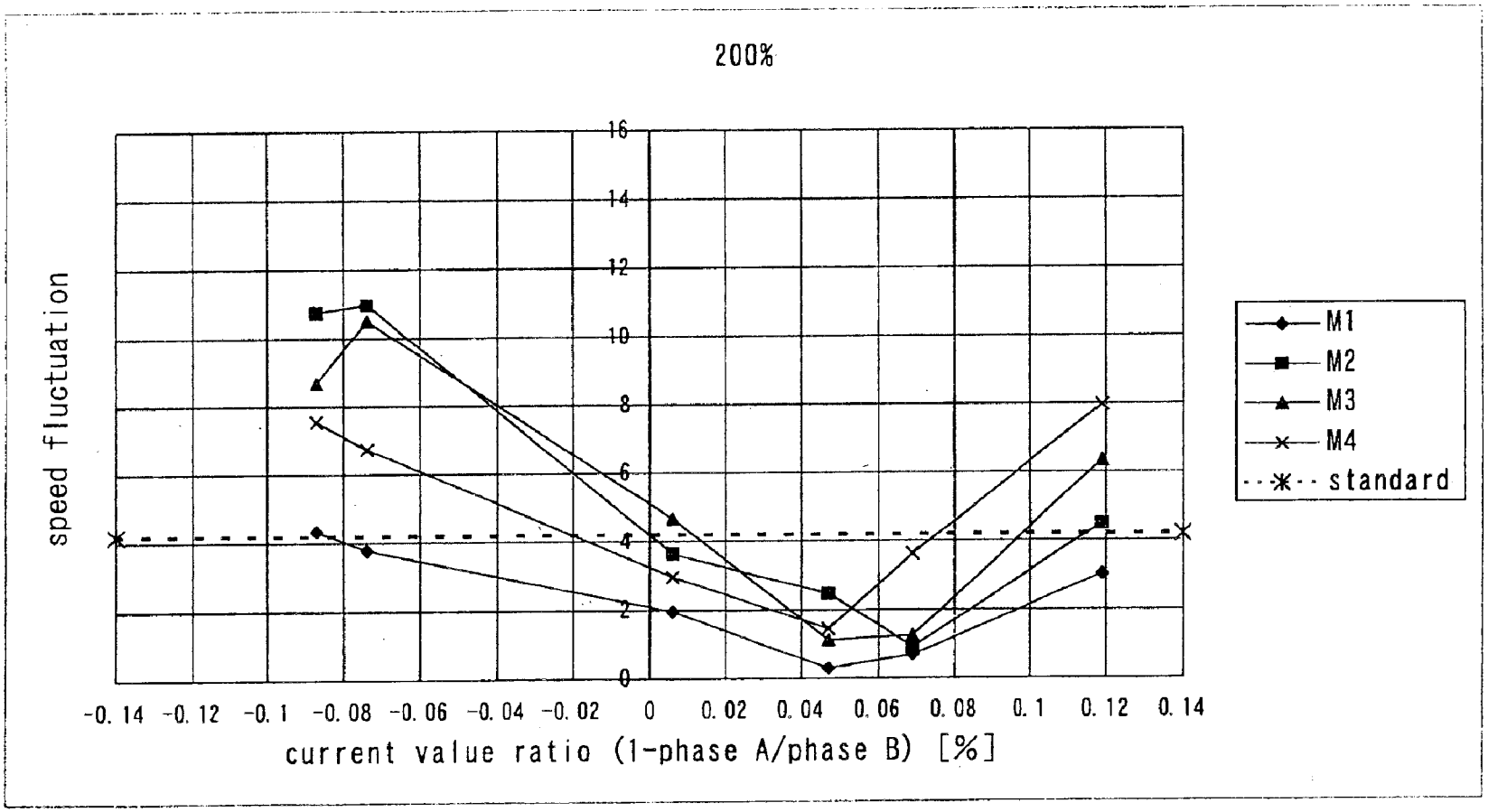
FIG. 10 is a graph showing the relationship between current ratios and speed fluctuations, obtained from the table as shown in FIG. 8, with parameters of motor wow and flutter.
Figure 11:
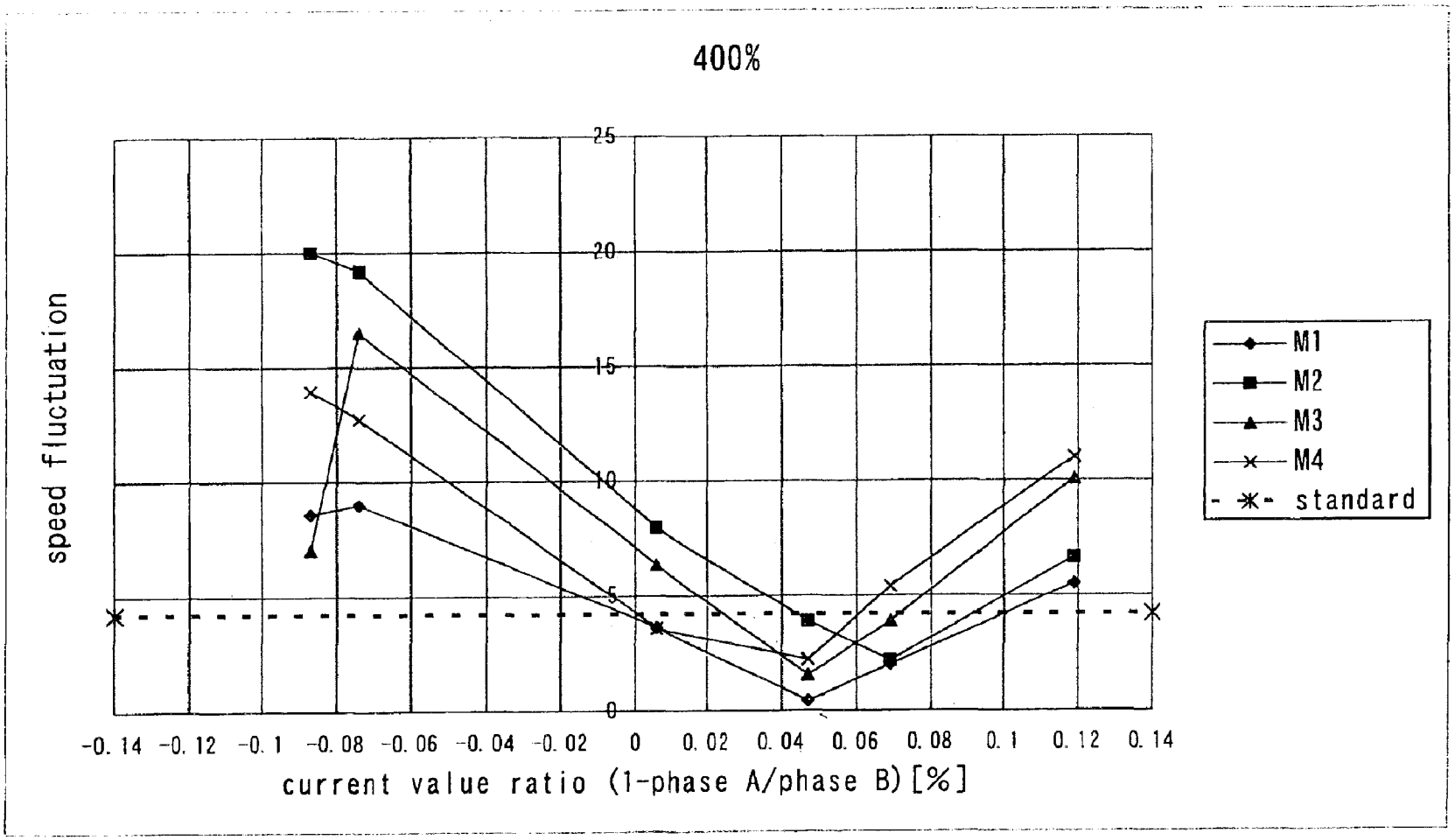
FIG. 11 is a graph showing the relationship between current ratios and speed fluctuations, obtained from the table as shown in FIG. 9, with parameters of motor wow and flutter.

FIGS. 10 and 11 are graphs indicating the relationship between current value ratios and speed fluctuations according to individual motors as parameters, as copied at a magnification rate of 200% in FIG. 10 and 400% in FIG. 11. According to these graphs, speed fluctuations have proved to be the best controlled when using control substrate #12 at a current value ratio of 4.7%, independently of the type of the motor. In addition, speed fluctuations are better controlled than when supplying motors M1 to M4 with standardized current.

Figure 12:
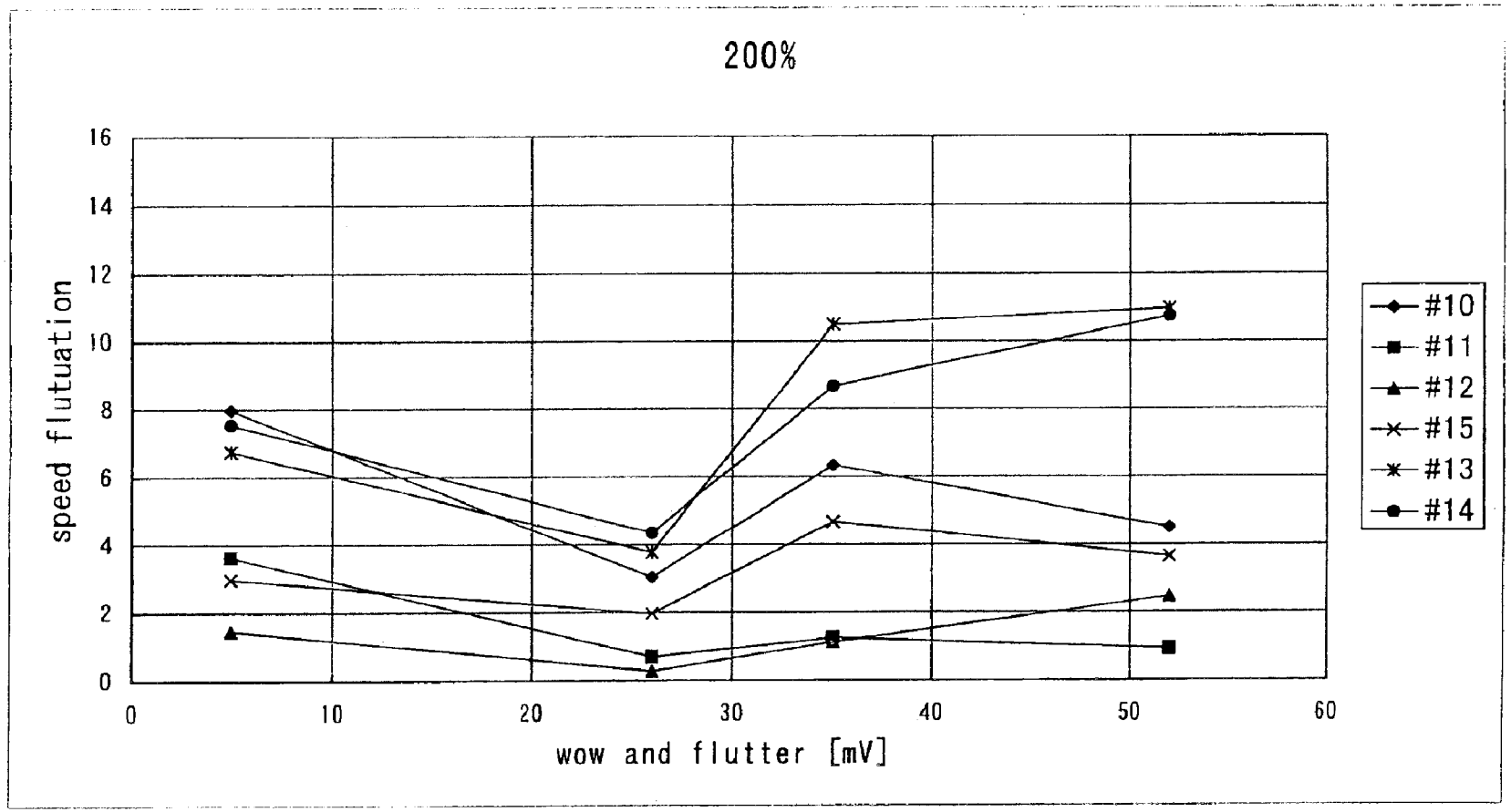
FIG. 12 is a graph showing the relationship between wow and flutter and speed fluctuations, obtained from the table as shown in FIG. 8, with parameters of two-phase current ratios fed to the motor.
Figure 13:
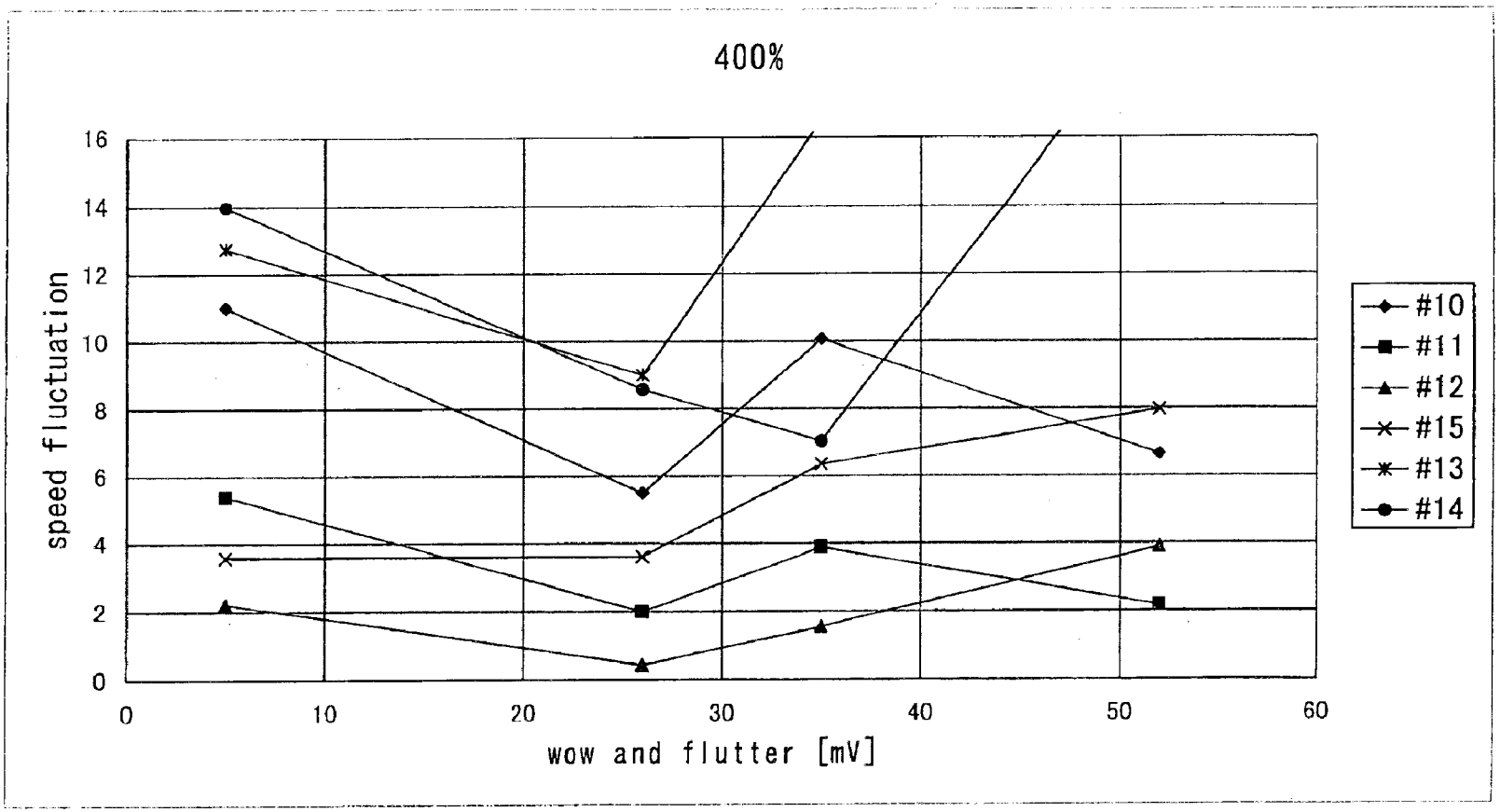
FIG. 13 is a graph showing the relationship between wow and flutter and speed fluctuations, obtained from the table as shown in FIG. 9, with parameters of two-phase current ratios fed to the motor.

Then, FIGS. 12 and 13 are graphs to indicate relationship between wow and flutter and speed fluctuations at motor M (i.e., 20) according to current value ratios as parameters, as copied at a magnification rate of 200% in FIG. 12 and 400% in FIG. 13. According to these graphs, speed fluctuations have proved to be the smallest at wow and flutter of 26 mV, independently of the current ratio values. Therefore, according to FIGS. 10 to 13, speed fluctuations have proved to be the smallest at current value ratio of 4.7% using the motor with wow and flutter of 26 mV.

The above wow and flutter or irregularities in characteristics of a drive motor 20 are difficult to adjust after being built into an image reader. However, the current value ratio can be adjusted. Then, speed fluctuations can be suppressed at drive motor 20 by making difference in current value between phases A and B in supplying drive motor 20 of image reader 1 with two-phase current, thereby allowing carriages 3 and 4 to travel at a constant speed to move light source lamp 9, reflectors 11, 12 and 13 carried on the same carriages to obtain image data of an original.

The speed stabilizer of the embodiment as shown in FIG. 2 can change the current value between phases A and B to feed drive motor 20 by connecting current regulating variable resistors 42*a* and 42*b* to constant current drive circuits 41*a* and 41*b*. Then, speed fluctuations at drive motor 20 are thought to occur also in case of any change in temperature at drive motor 20 in itself or at its drive circuit 41. Then, to cope with increase in speed fluctuations, if any, current regulating variable resistor 42*b* is adjusted in resistance value to change the output current value of the drive circuit, to adjust current value ratios at phases A and B to improve speed fluctuations. In this case, it should be adjusted, while checking speed fluctuations detected by vibration analyzer 47, regarding rotation acceleration of drive motor 20 detected by the above acceleration pickup 46.

Moreover, a conventional arithmetic circuit, for example, to make appropriate current value ratios between phase A and B, based on the detected results, may be connected to the above vibration analyzer 47 (FIG. 1), in order to provide output signals to the above current regulating variable resistor 42. Then, a tentative scan is tried before a definitive scan to obtain image data at image reader 1. An optimal current value ratio is computed, based on speed fluctuations obtained by the above commercially available vibration analyzer 47 from rotation of motor 20 during the tentative scan. Based on the information, resistance value at current regulating variable resistor 42*b* is changed to adjust the supply current value for drive motor 20. Then, image data faithful to the original are obtained by a definitive scan carried out at a constant speed.

In the embodiment as shown in FIG. 3, control circuit 43 feeds constant current drive circuits 41*a* and 42*a* at different voltage values as needed. In the embodiment as shown in FIG. 4, difference can be made in voltage value to feed constant current drive circuits 41*a* and 41*b* by changing the position of the wiper arm of potential divider 44.

Figure 14:
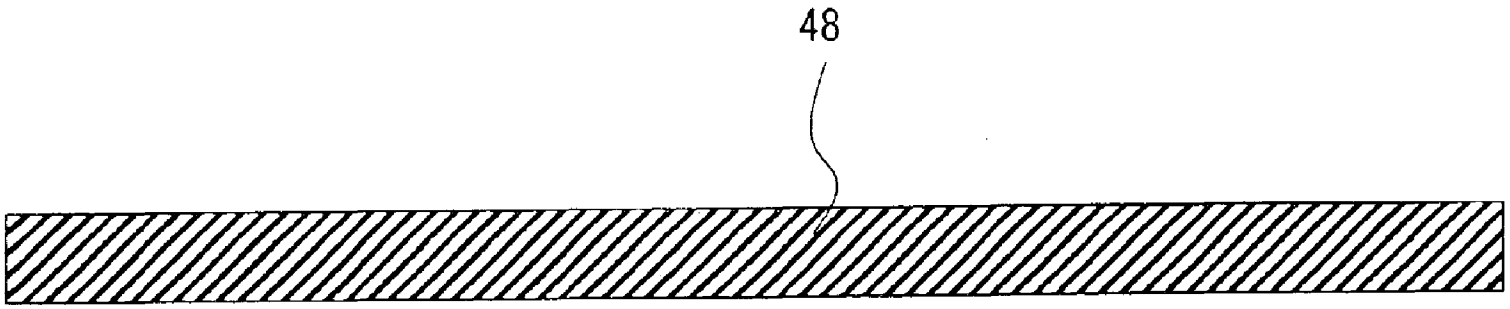
FIG. 14 is a plan view of a test chart appropriately used for a speed stabilizer according to the present invention to detect speed fluctuations at the light source lamp.

FIG. 14 is a plan view to show an example of test chart 48 appropriately used to measure speed fluctuations at light source lamp 9, when image reader 1 is working. This test chart 48 is formed of a sheet as wide as not to bother measurement of speed fluctuations, stuck on the underside of top plate 2*g* of housing 2, as shown with a broken line, along the direction as carriages 3 and 4 move. Then, the above platen glasses 6 and 7 are fixed at opening 2*h* opened at the center of top plate 2*g*. Then, the above light source lamp 9 irradiates light beams also on this test chart 48 and the reflected light beams are reflected by the reflectors 11, 12 and 13 to be incident onto photoelectric converter device 15, allowing image data of the test chart 48 to be obtained. The image data obtained in this scan of test chart 48 and image data of a test chart 48 obtained at a constant speed are compared by detecting means to detect speed fluctuations of carriage 3. As a result, the optimal current value ratio at each phase (A and B) can be obtained by arithmetic means from the detected data.

Due to the speed stabilizer according to the embodiment with test chart 48 as shown in FIG. 14, image data of the test chart 48 are obtained during a tentative scan, speed fluctuations of carriage 3 are detected by the above detecting means from the results, an optimal current value ratio is obtained by the above arithmetic means, based on the detected data, resistance value is changed by the information at either or both of current regulating variable resistors 42*a* and 42*b* to change the current value at either or both of phases A and B. Then, image data faithful to the original can be obtained by a definitive scan, since carriages 3 and 4 are traveling at a constant speed.

Figure 15:
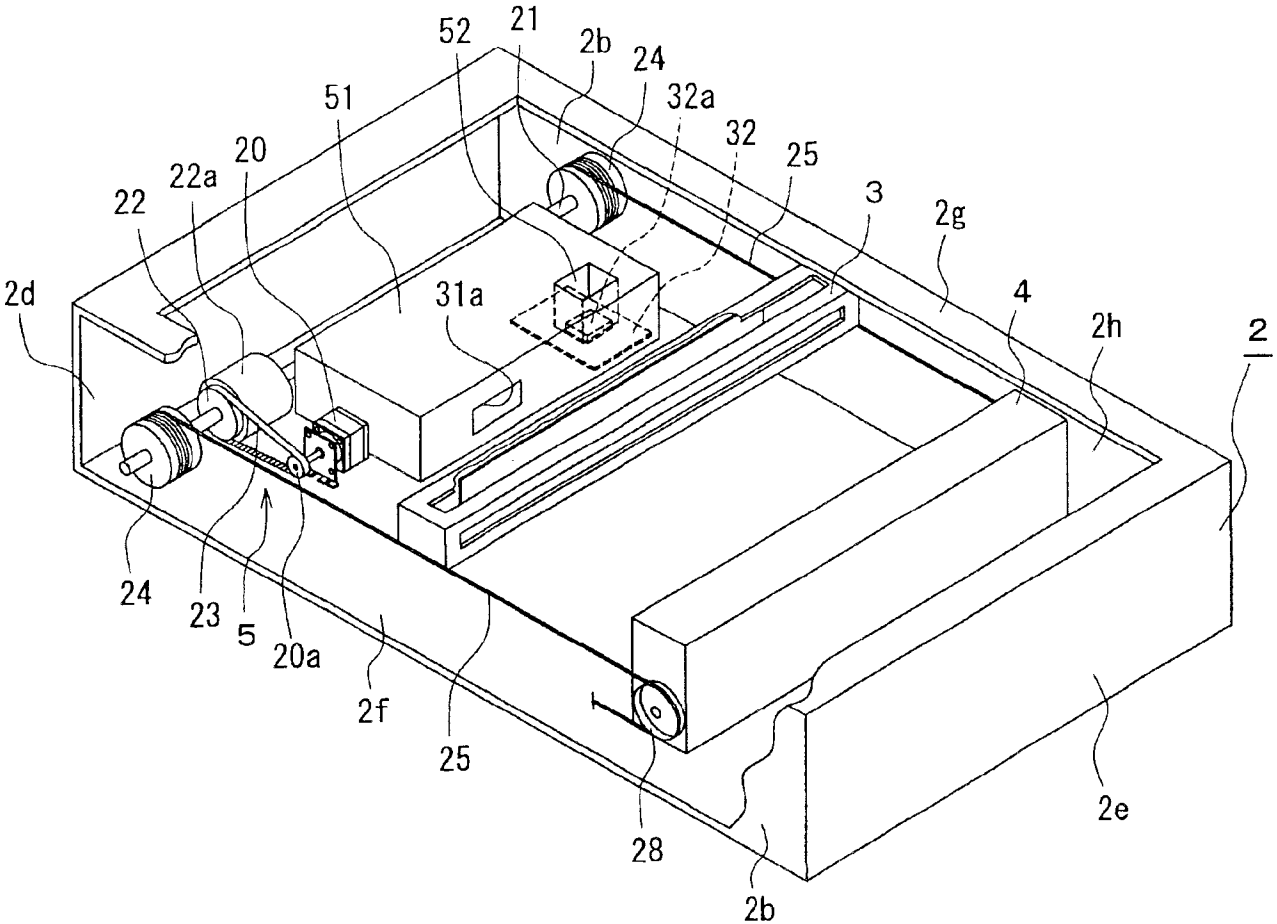
FIG. 15 is a perspective view of a first embodiment of a cooling structure appropriate to be comprised by an image reader having a speed stabilizer according to the present invention.
Figure 16:
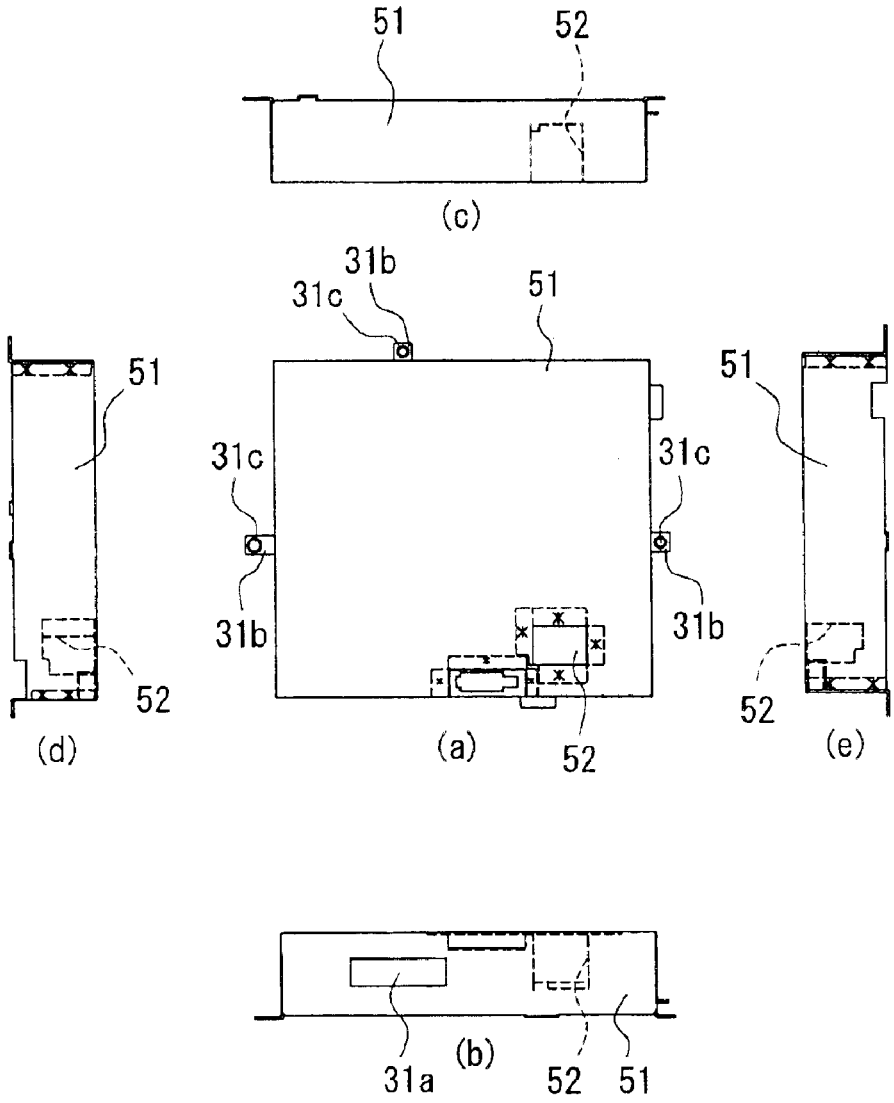
FIGS. 16(*a*) is a top plan view, 16(*b*) is a front elevational view, 16(*c*) is a rear elevational view, 16(*d*) is a left side view and 16(*e*) is a right side view of a lens cover provided with a cooling structure as shown in FIG. 15.
Figure 17:
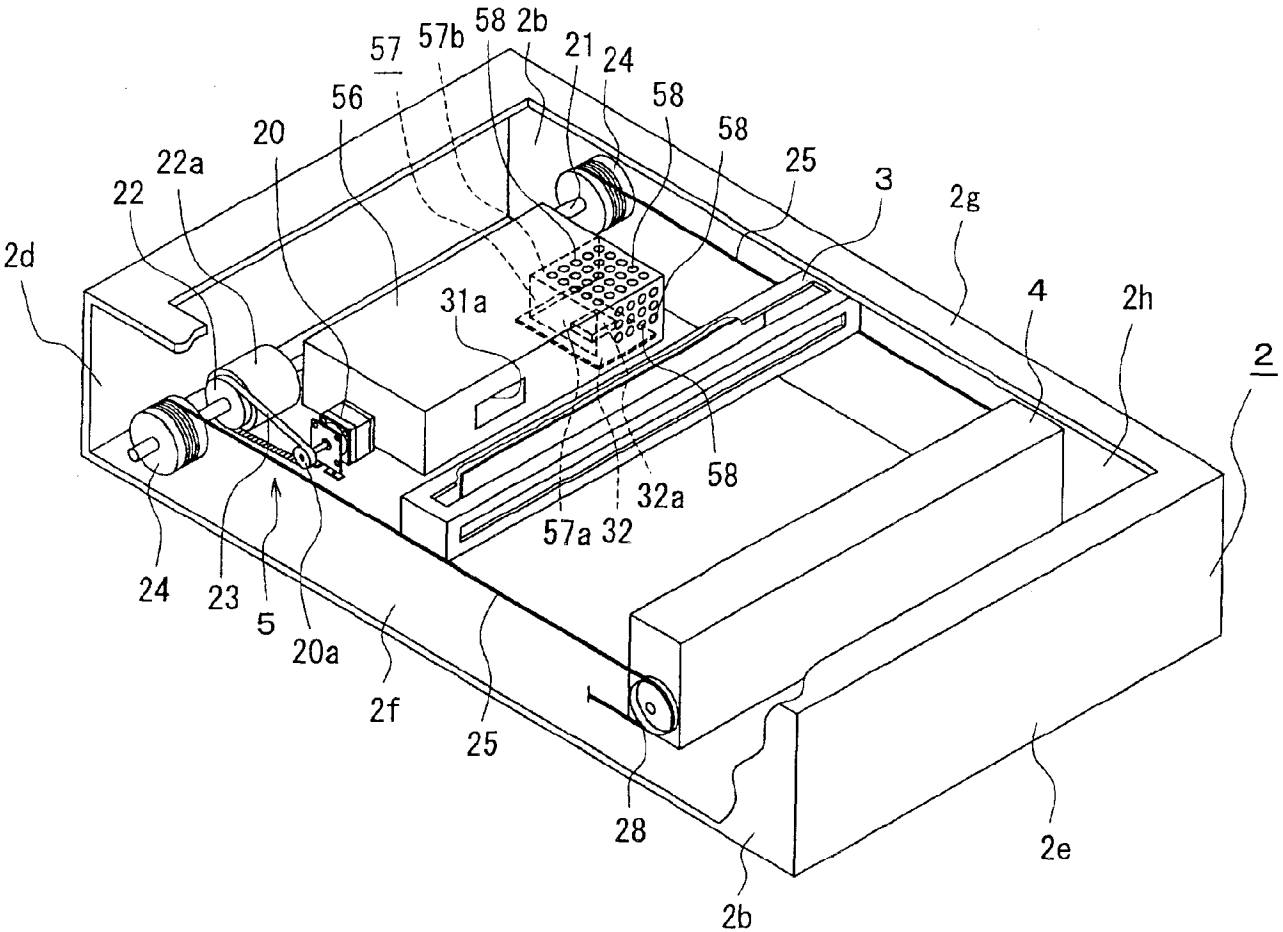
FIG. 17 is a perspective view of a second embodiment of a cooling structure appropriate to be comprised by an image reader having a speed stabilizer according to the present invention.
Figure 18:
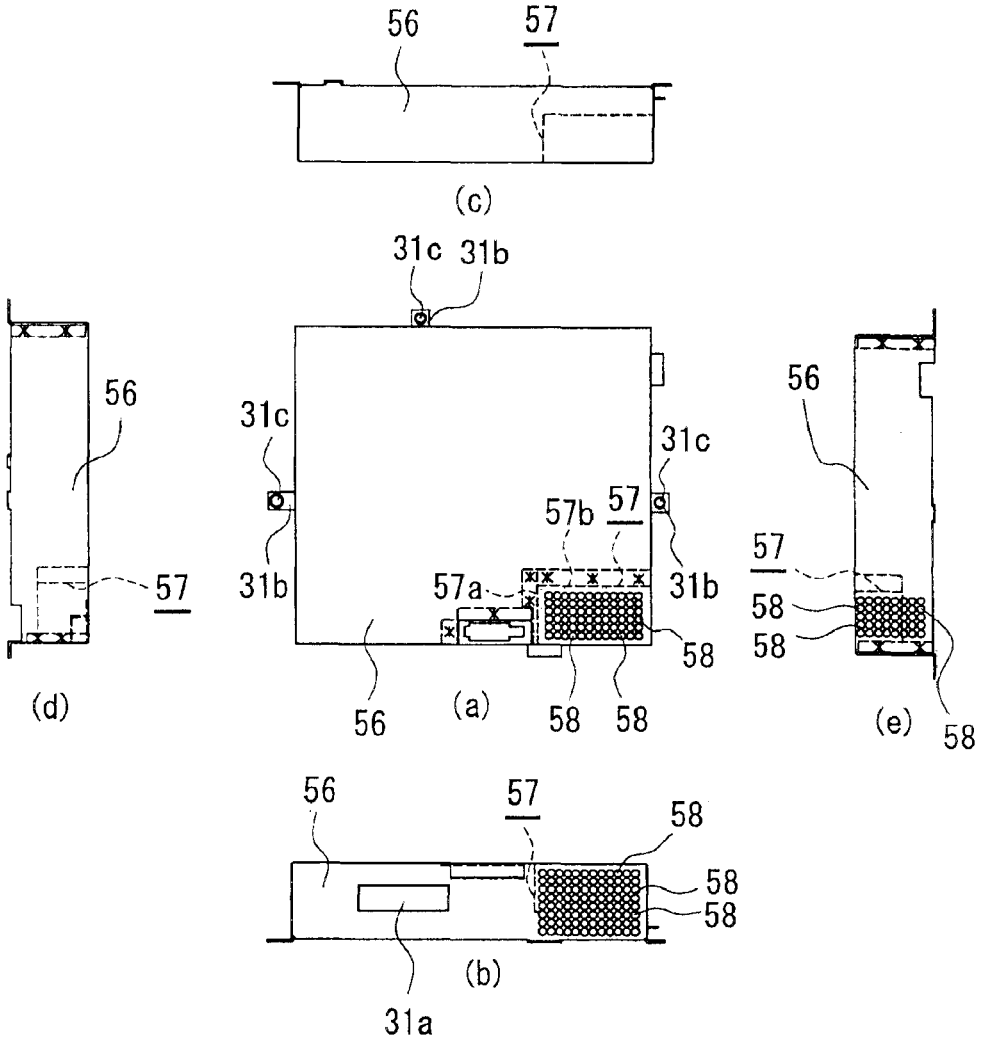
FIGS. 18(*a*) is a top plan view, 18(*b*) is a front elevational view, 18(*c*) is a rear elevational view, 18(*d*) is a left side view and 18(*e*) is a right side view of a lens cover provided with a cooling structure as shown in FIG. 17.
Figure 19:
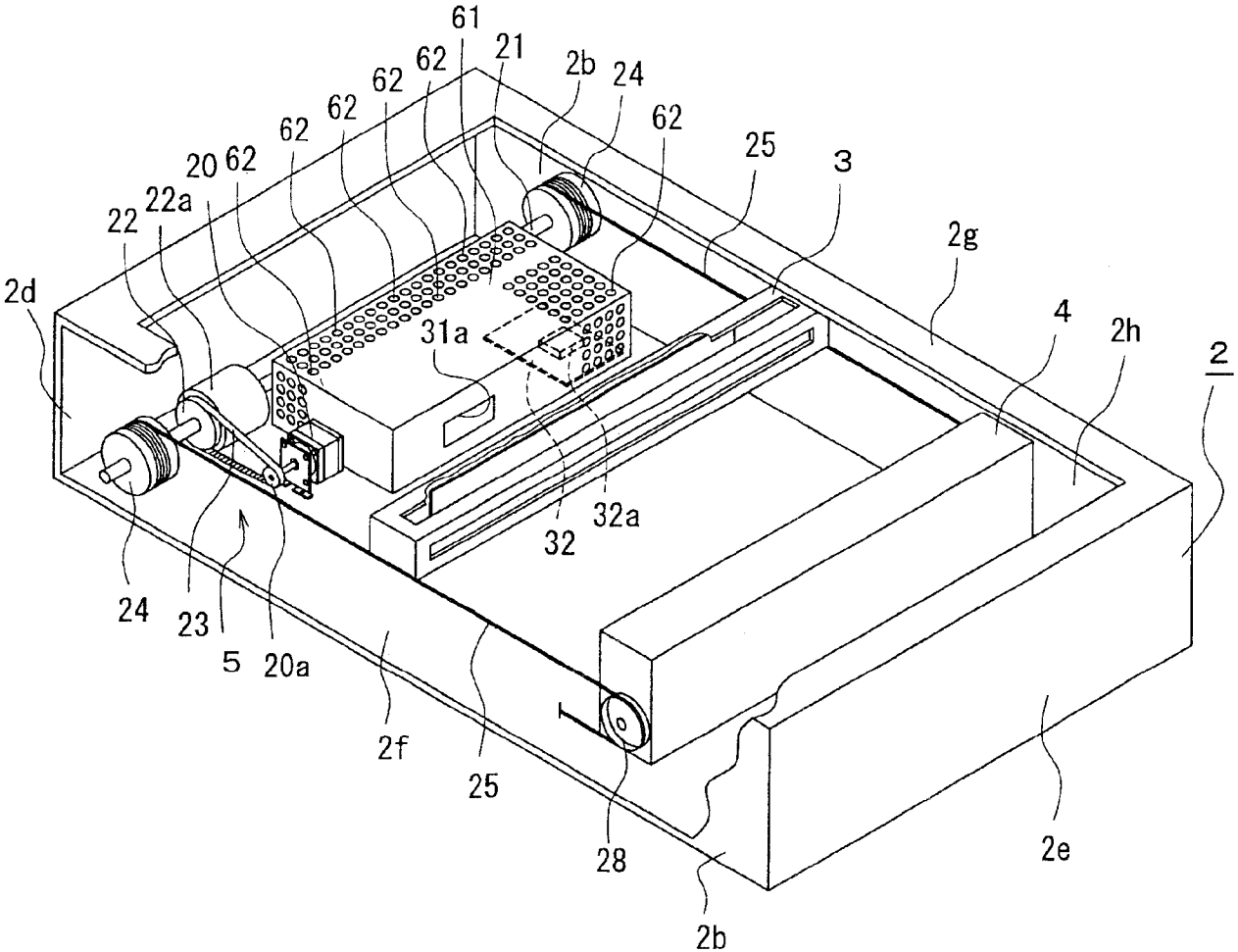
FIG. 19 is a perspective view of a third embodiment of a cooling structure appropriate to be comprised by an image reader having a speed stabilizer according to the present invention.
Figure 20:
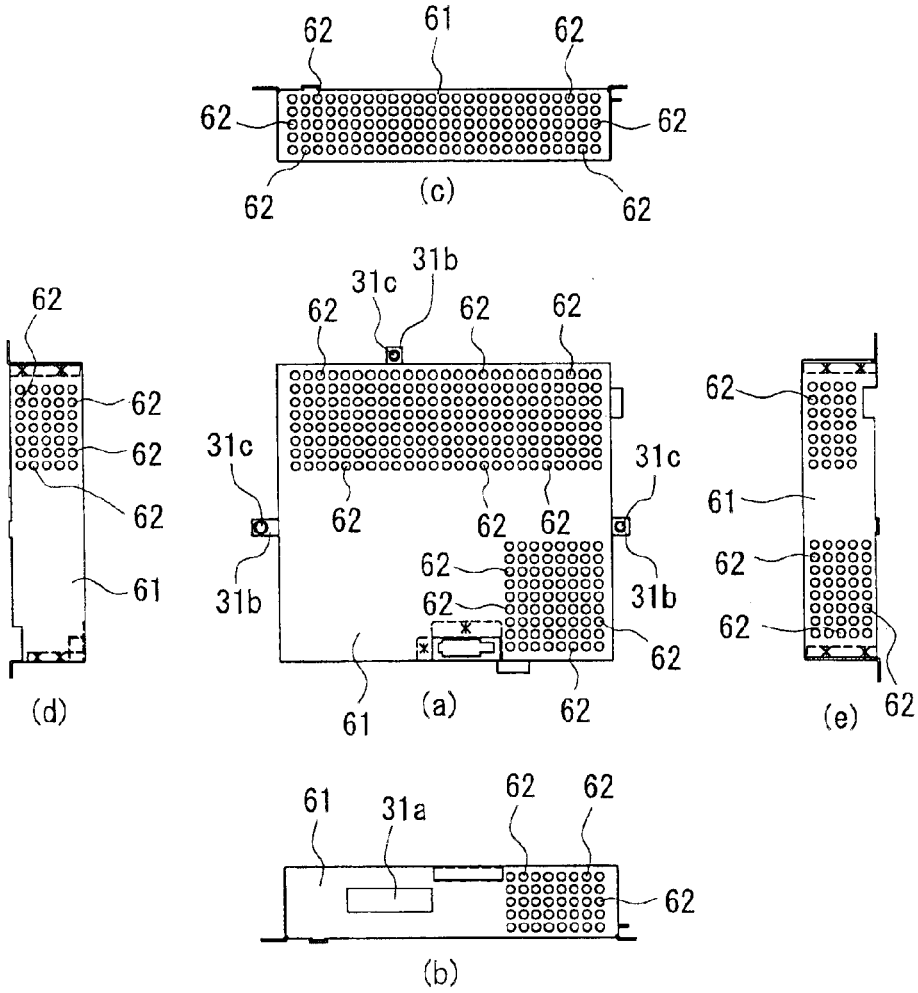
FIGS. 20(*a*) is a top plan view, 20(*b*) is a front elevational view, 20(*c*) is a rear elevational view, 20(*d*) is a left side view and 20(*e*) is a right side view of a lens cover provided with a cooling structure as shown in FIG. 19.
Figure 21:
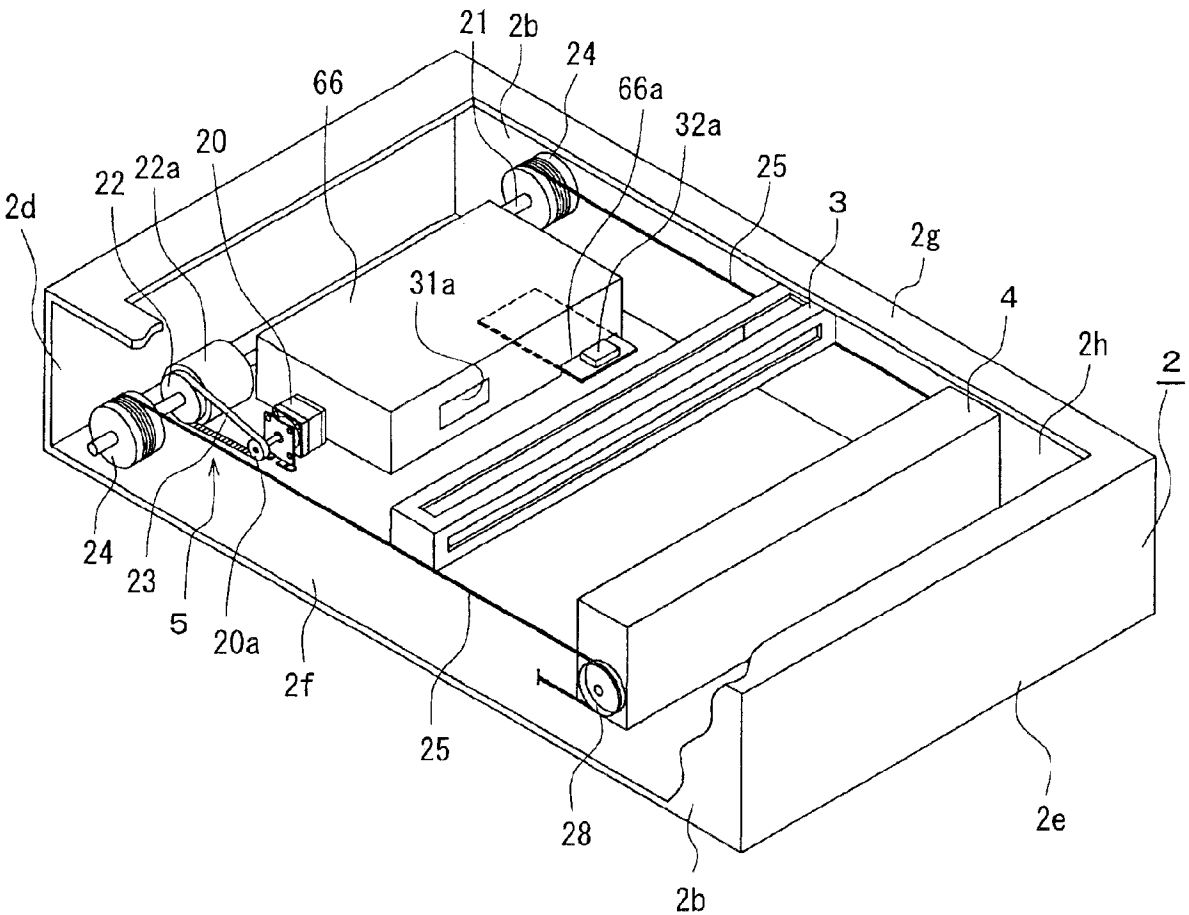
FIG. 21 is a perspective view of a fourth embodiment of a cooling structure appropriate to be comprised by an image reader having a speed stabilizer according to the present invention.
Figure 22:
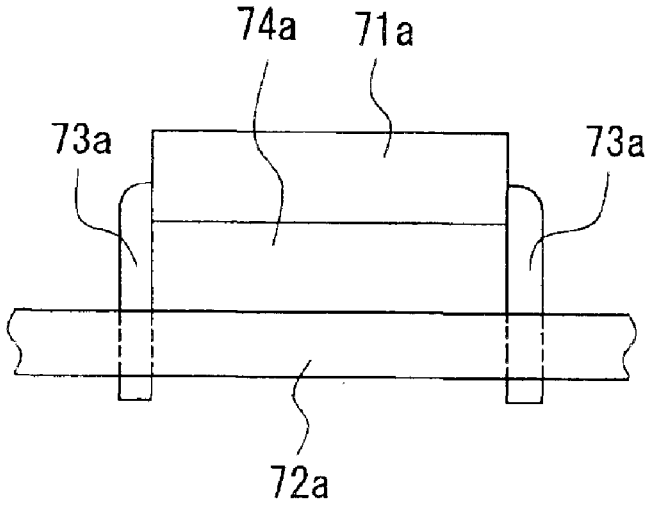
FIG. 22 is a fragmentary sectional view of a fifth embodiment of a cooling structure appropriate to be comprised by an image reader having a speed stabilizer according to the present invention, with a drive IC installed on a drive circuit substrate.

Speed fluctuations of drive motor 20 may increase with higher temperatures at drive motor 20 or drive circuit 41, when image data are repeatedly obtained during continuous operation of image reader 1 equipped with the speed stabilizer according to any of the above embodiments. Then, drive IC 32*a* of drive circuit 41 in particular should be cooled. FIGS. 15 to 23 shows speed stabilizers equipped with a cooling structure constituting cooling means for drive IC 32*a*. FIGS. 15 and 16 show a first embodiment of this cooling structure; FIGS. 17 and 18 a second embodiment; FIGS. 19 and 20 a third embodiment; FIG. 21 a fourth embodiment; FIG. 22 a fifth embodiment; and FIG. 23 a sixth embodiment respectively. The same parts as in the structures shown in FIGS. 5 to 7 are indicated with the same reference numerals in these drawings showing these embodiments.

In the first embodiment of the cooling structure as shown in FIGS. 15 and 16, drive IC 32*a* is integrated at the center of drive circuit substrate 32. It has ventilation duct 52 at a part of lens cover 51 faced with drive IC 32a. Ventilation duct 52 is open at one end to face drive IC 32*a* and open on the upper face of lens cover 51 at the other end.

In the speed stabilizer equipped with a cooling structure according to the first embodiment, drive IC 32*a* is cooled, as spaced from the inside of lens cover 51 and kept in touch with the air outside lens cover 51. Then, it can minimize speed fluctuations due to change in temperature at drive motor 20 driven by drive IC 32*a*.

In the cooling structure as shown in FIGS. 17 and 18 according to the second embodiment, drive IC 32*a* is integrated at the center of drive circuit 32. IC housing 57 is arranged with a pair of inner wall plates 57*a* and 57*b* to partition an inner corner of lens cover 56. Drive IC 32*a* is housed in this IC housing 57 and drive circuit substrate 32 should also preferably be placed in this IC housing 57. Then, a part of lens cover 56 is enclosed with this IC housing 57 and perforated with many through holes 58 through which IC housing 57 communicates between its own inside and outside.

In the speed stabilizer equipped with the cooling structure of this second embodiment, drive IC 32*a* is isolated by IC housing 57, while the inside of IC housing 57 communicates with the outside of lens cover 56 by means of through holes 58, to ventilate the air inside IC housing 57 and to cool drive IC 32*a*, thereby minimizing speed fluctuations due to change in temperature at drive motor 20 driven by drive IC 32.

In the third embodiment as shown in FIGS. 19 and 20 relating to the above cooling structure, many ventilation ports 62 are formed on lens cover 61 around drive IC 32*a* and CCD circuit substrate 33 both housed in the lens cover 61, to facilitate ventilation inside lens cover 61 to cool drive IC 32*a* in the speed stabilizer equipped with a cooling structure according to the third embodiment, thereby minimizing speed fluctuations due to change in temperature at drive motor 20 driven by drive IC 32*a*, while suppressing micro changes at the signal level or clock timing of the circuit in CCD circuit substrate 33 due to temperature at the same time.

In the fourth embodiment as shown in FIG. 21 relating to the above cooling structure, drive IC 32*a* is integrated at an end of drive circuit substrate 32. Lens cover 66 has a notch 66*a*, where faced with the drive circuit substrate 32, to allow insertion of the drive circuit substrate 32 from the lower end. An end of drive circuit substrate 32 projects from this notch 66*a* to outside of lens cover 66 and drive IC 32*a* is integrated at this projection. In other words, drive IC 32*a* is placed outside lens cover 66.

In the speed stabilizer equipped with a cooling structure of the fourth embodiment, drive IC 32*a* is cooled, as exposed to the air outside lens cover 66, thereby minimizing speed fluctuations due to change in temperature at drive motor 20 driven by drive IC 32*a*.

Figure 23:
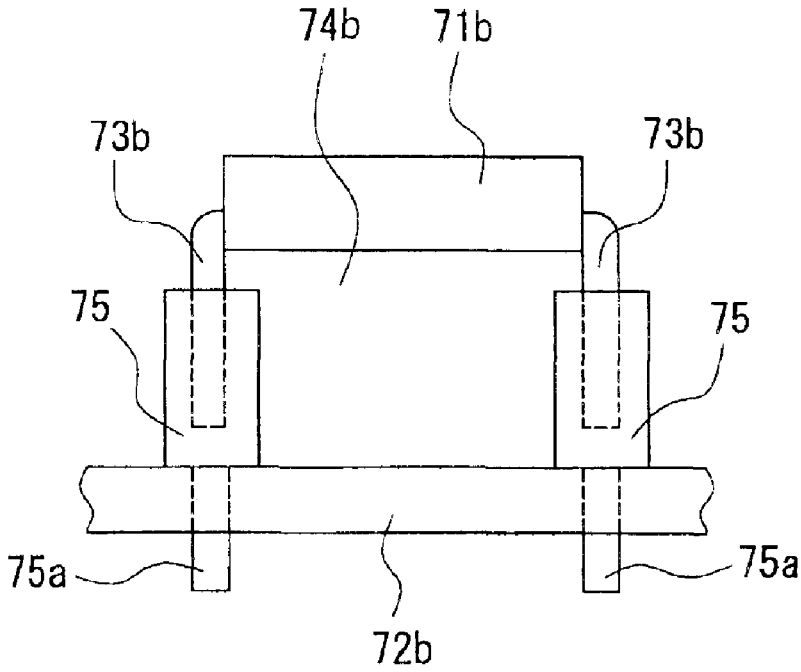
FIG. 23 is a fragmentary sectional view of a sixth embodiment of a cooling structure appropriate to be comprised by an image reader having a speed stabilizer according to the present invention, with a drive IC installed on a drive circuit substrate.
Figure 24:
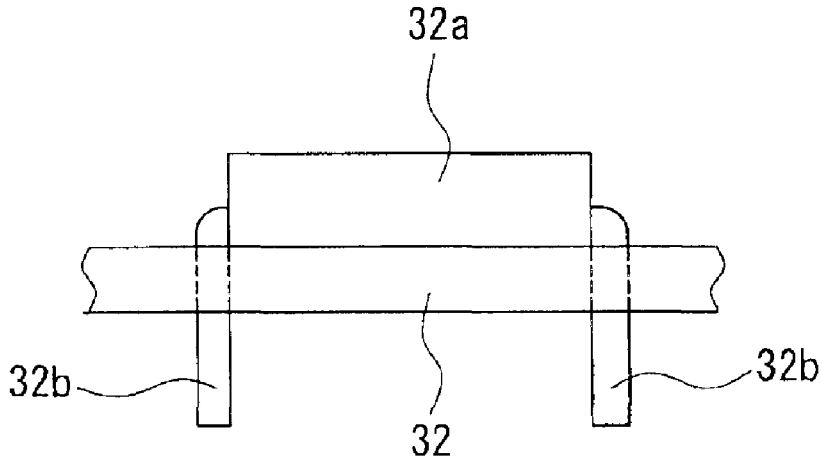
FIG. 24 is a sectional view to illustrate a conventional structure with a drive IC installed on a drive circuit substrate.

FIG. 22 shows the fifth embodiment of cooling structure, and FIG. 23 shows the sixth embodiment of the same. FIG. 24 shows a conventional structure used prior to these invention embodiments. In the conventional structure as shown in FIG. 24, connection pin 32*b* of drive IC 32*a* is inserted into a through hole opened on drive circuit substrate 32 and soldered to make electrical connection between drive IC 32*a* and drive circuit substrate 32. In this case, drive IC 32*a* is integrated in touch with drive circuit substrate 32. Then, heat is not dissipated at the bottom, failing to suppress temperature rise at drive IC 32*a* sufficiently. In the fifth and sixth embodiments, however, drive IC 71 is vertically spaced from drive circuit substrate 72 to assure ventilation between drive IC 71 and drive circuit substrate 72 to facilitate cooling of drive IC 71 and drive circuit substrate 72.

In the fifth embodiment as shown in FIG. 22, space 74*a* is formed between drive IC 71*a* and drive circuit substrate 72*a*, when soldering pin 73 of drive IC 71*a*, with connection pin 73*a* inserted into a through hole formed on drive circuit substrate 72*a*, improving ventilation and facilitating cooling between drive IC 71*a* and drive circuit substrate 72*a*, thereby minimizing speed fluctuations due to temperature change at drive motor 20 driven by drive IC 71*a*.

In the sixth embodiment as shown in FIG. 23, connection pin 75*a* of connector 75 is inserted into a through hole of drive circuit substrate 72*b* and soldered. This connector 75 is connected with connection pin 73*b* of drive IC 71*b* to form space 74*b* between drive IC 71*b* and drive circuit substrate 72*b*, thereby improving ventilation and facilitating cooling between drive IC 71*b* and drive circuit substrate 72*b* to minimize speed fluctuations due to temperature change at drive motor 20 driven by drive IC 71*b*.

Figure 25:
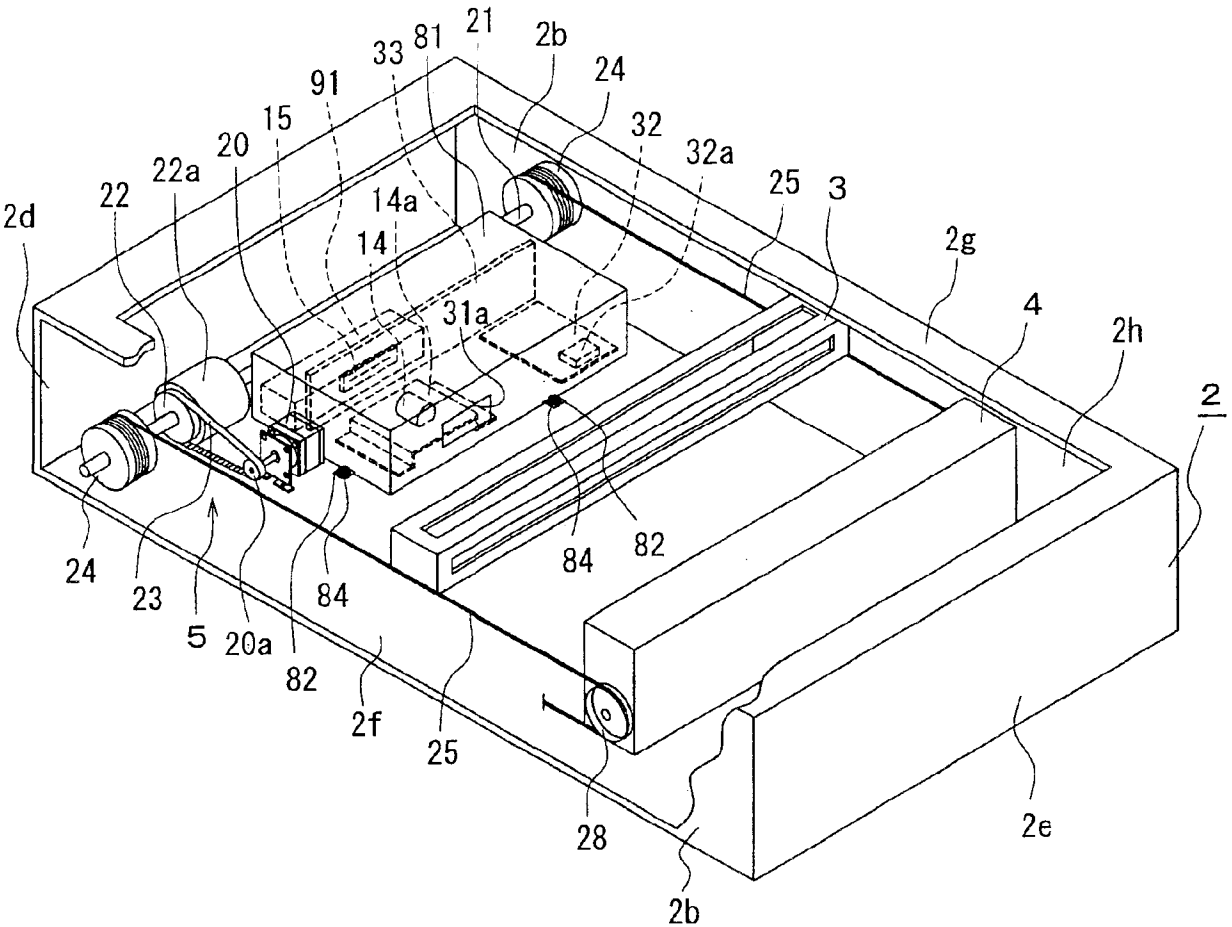
FIG. 25 is a perspective view of a first embodiment of a vibration proofing structure appropriate to be comprised by an image reader having a speed stabilizer according to the present invention.
Figure 26:
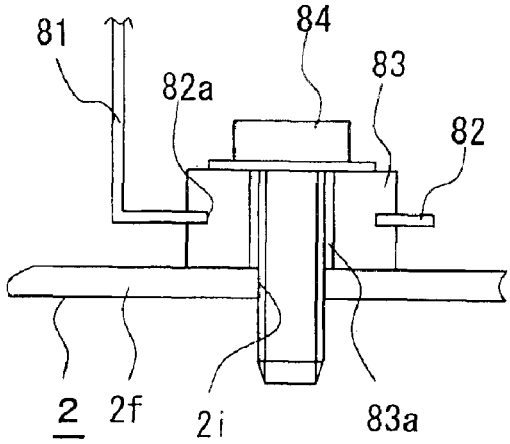
FIG. 26 is a fragmentary sectional view of a vibration proofing structure, shown in FIG. 25, with a lens cover installed on the bottom plate of a housing.
Figure 27:
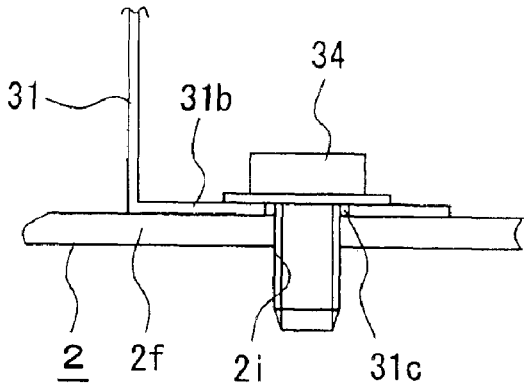
FIG. 27 is a fragmentary sectional view to illustrate a conventional structure with a lens cover installed on the bottom plate of a housing.
Figure 28:
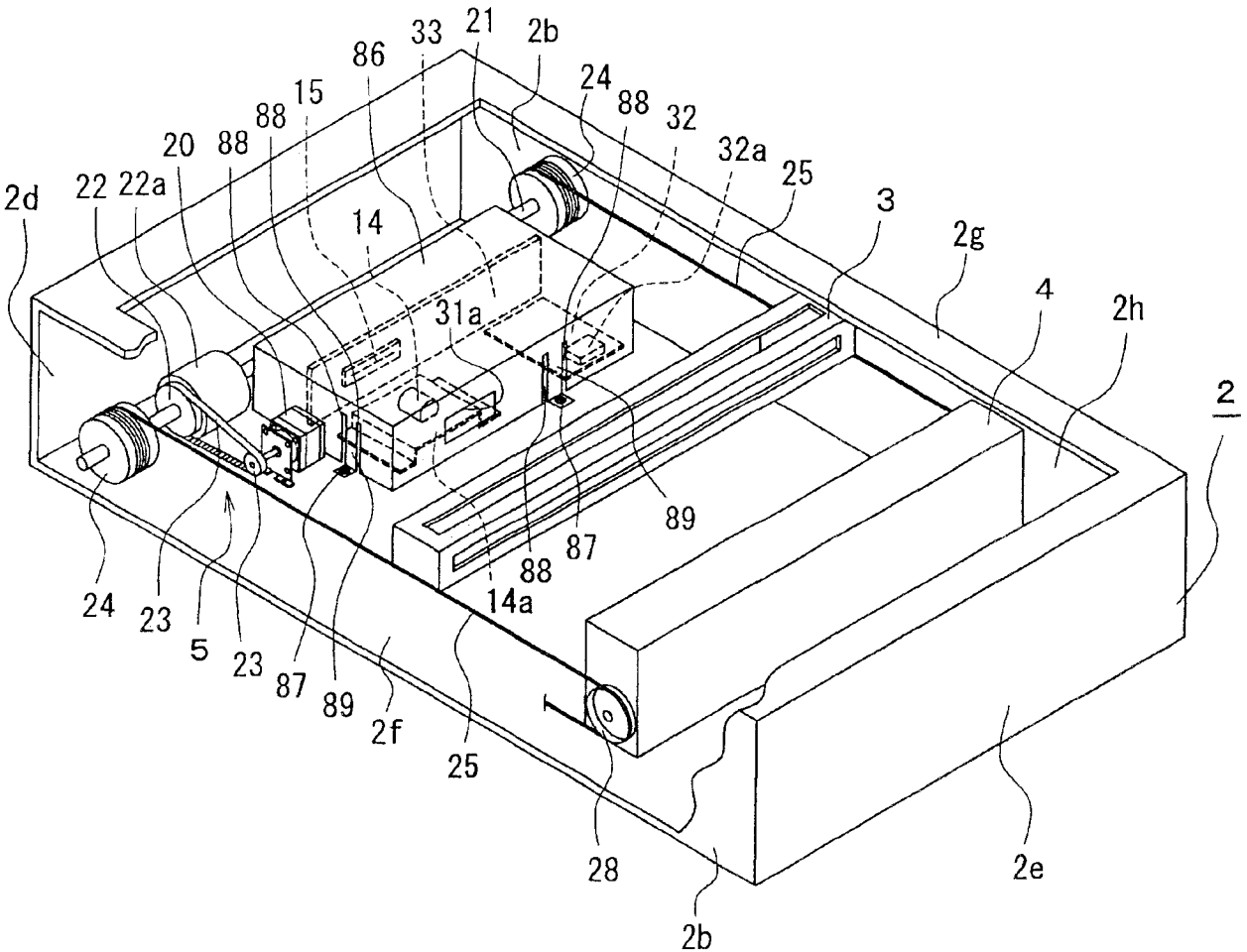
FIG. 28 is a perspective view of a second embodiment of a vibration proofing structure appropriate to be comprised by an image reader having a speed stabilizer according to the present invention.

Speed fluctuations at drive motor 20 are minimized in obtaining image data by image reader 1 equipped with the above mentioned speed stabilizer. However, it is difficult to perfectly prevent vibration of motor 20 and such vibration may cause a problem, if transmitted to CCD circuit substrate 33, where photoelectric converter device 15 is built in and vibrates the photoelectric converter device 15. Vibration proofing means of the present invention can be installed to prevent vibration of drive motor 20 from being transmitted to CCD circuit substrate 33. FIGS. 25, 26 and 28 show vibration proofing means appropriately installed on image reader 1 equipped with this speed stabilizer, FIGS. 25 and 26 showing a vibration proofing structure relating to vibration proofing means of the first embodiment and FIG. 28 showing a vibration proofing structure of the second embodiment respectively. Then, the same reference numerals as used in FIGS. 5 to 7 are used where they indicate equivalent structure in drawings showing these embodiments.

Conventionally, the above lens cover 31 is fixed at bottom plate 2*f* of housing 2 with fixing screw 34, as shown in FIGS.

6 and 27. In other words, fixing screw 34 is inserted into through hole 31*c* formed on fixing tongue 31*b* formed, as outward projected where appropriate at the lower end of lens cover 31 to be tightly screwed into female screw 2*i* formed on bottom plate 2*f* of housing 2. However, vibration of the above drive motor 20 may be transmitted from housing 2 to lens cover 31, producing resonance at a certain vibration frequency, to be further transmitted to CCD circuit substrate 33. Then, as shown by the respective embodiments in FIGS. 25, 26 and 28, it is provided with vibration proofing means to suppress vibration from housing 2 to lens cover 31.

In the first embodiment relating to this vibration proofing means as shown in FIGS. 25 and 26, a bushing 83 made of elastic material is fitted approximately midway into through hole 82*a* formed at fixing tongue 82 of lens cover 81. Fixing screw 84 is inserted into through hole 83*a* formed on this bushing 83 to be tightly screwed into female screw 2*i* formed on bottom plate 2*f* of housing 2 to fix lens cover 81 on bottom plate 2*f* of housing 2. Then, this bushing 83 should preferably be formed of elastic material, such as vibration proofing rubber, sufficient to absorb vibration.

In the speed stabilizer equipped with vibration proofing structure according to this first embodiment, vibration generated at drive motor 20 is cushioned at the above bushing 83, minimizing transmission to lens cover 81, thereby preventing vibration from being transmitted to photoelectric converter device 15 to obtain image data most faithful possible to an original.

Then, as shown in FIG. 25, spindle 91 is arranged on bottom plate 2*f* to attenuate, as needed, vibration generated at drive motor 20 and transmitted to where spindle 91 is placed. Therefore, this spindle 91 should preferably be placed at some midpoint in transmission path for vibration at drive motor 20 to be transmitted to photoelectric converter device 15.

In the second embodiment, a pair of notches 88 having an appropriate length are formed at both sides of fixing tongue 87 formed, as projected outward where appropriate at the lower end of lens cover 86, as shown in FIG. 28. Fixing tongue 87 is formed at the tip of supporting arm 89 between the pair of notches 88.

In the speed stabilizer equipped with vibration proofing structure of this second embodiment, vibration at housing 2 is cushioned by appropriate flexion of the above supporting arm 89, thereby preventing it from being transmitted to anywhere else but supporting arm 89 of lens cover 86. Transmission of vibration to photoelectric converter device 15 is thus prevented to obtain image data most faithful possible to an original.

This vibration proofing structure of the second embodiment can be combined with the structure of the first embodiment carrying the above spindle 91, thereby further attenuating the vibration and minimizing its transmission to photoelectric converter device 15.

As explained above, speed fluctuations at a drive motor can be suppressed by the method and device for pacing an image reader at a constant scanning speed according to the present invention, with a light source lamp traveling at a constant speed, to obtain image data most faithful possible to an original. In addition, the construction can be simplified, making difference in current value at each phase of two phase current to feed the drive motor, while facilitating adjustment to reduce speed fluctuations by adjusting the current value.

Adjustment in current value is facilitated and allowed, as needed, even during operation of the image reader, due to the method for pacing an image reader at a constant scanning speed, making a current value variable at either of the above two phase current to make difference in current value at each phase or due to a device for pacing an image reader at a constant scanning speed, using a variable resistor as a motor current detecting resistor at least at either phase of the drive circuit, varying the resistance value of the motor current detecting resistor that is a variable resistor to adjust in current value at either of two phase current to drive the drive motor. As a result, adjustment is made easy also in case of speed fluctuations at image reader e.g. due to aging, always allowing image data most faithful possible to an original to be obtained. Similarly, the drive motor can be readily and quickly adjusted at each phase of drive current, due to a device for pacing an image reader at a constant scanning speed, in which the drive circuit is supplied with motor current setting reference voltage from a control circuit separately at each phase to vary the motor current setting reference voltage to adjust in current value at either of the two phase current to drive the drive motor or due to a device for pacing an image reader at a constant scanning speed, in which a current value setting reference voltage supplied to a drive circuit to feed at each phase of the drive motor from the control circuit is inputted, as it is, to either reference voltage input terminal of the drive circuit, while a voltage generated by dividing the supplied reference voltage by a variable resistor is inputted to the other terminal, varying the resistance value of the variable resistor to adjust in current value at either of the two phase current to drive the drive motor.

Then, the current value is adjusted on detecting speed fluctuations at drive motor to enable reduction of speed fluctuations at drive motor to be assured, by a method for pacing an image reader at a constant scanning speed, in which speed fluctuations at the drive motor are detected to change the current value at each phase of the current value, based on the detected result or by a device for pacing an image reader at a constant scanning speed, equipped with speed fluctuations detecting means to detect speed fluctuations at the drive motor to make difference in current value at each phase of the two phase current, based on the result detected by the speed fluctuations detecting means.

Image data as faithful as possible to an original can be obtained by assuring reduction of speed fluctuations at drive motor before obtaining image data of an original, by a method or a device for pacing an image reader at a constant scanning speed, in which a tentative scan is tried, detecting speed fluctuations at drive motor during the tentative scan, to adjust to make difference in current value at each phase of two phase current, based on the detected result, before a definitive scan to obtain image data.

Then, more faithful image data of an original can be obtained, as the current value to feed the drive motor is adjusted, based on working for actual scanning, according to a method for pacing an image reader at a constant scanning speed, in which speed fluctuations are detected when a light source lamp travels to make difference in current value at each phase of the two phase current, based on the detected result.

Then, image data most faithful possible to an original can be obtained, as speed fluctuations at light source lamp to scan an original are detected before obtaining image data of an original to adjust speed fluctuations at drive motor based on the detected result. This is achieved by a method for pacing an image reader at a constant scanning speed, in which a tentative scan is tried, detecting speed fluctuations at light source lamp during the tentative scan, to adjust to make difference in current value at each phase of two phase current, based on the detected result, before a definitive scan to obtain image data, or by a device for pacing an image reader at a constant scanning speed, in which a test chart is arranged somewhere not to bother obtaining image data of an original, on the above platen glass or on the underside of the top plate of the housing. A tentative scan is tried, obtaining image data for measurement of the test chart during the tentative scan. Speed fluctuations of a light source lamp from the image data for measurement are detected and used to adjust current value at each phase of two phase current, based on the detected result, before a definitive scan to obtain image data.

An original can be scanned at a constant speed, as the drive motor rotates at a constant speed, suppressing temperature rise at the drive circuit for a drive motor, by a device for pacing an image reader at a constant scanning speed, in which a circuit substrate integrating a drive circuit for the drive motor is housed in a cover to cover the light receptor, having also cooling means to cool the circuit substrate.

Image data more faithful to an original can also be obtained, as vibration generated by the drive motor is prevented from being transmitted to the photoelectric converter device and also due to constant rotation of the drive motor, by a device for pacing an image reader at a constant scanning speed, equipped with vibration proofing means to prevent vibration of the drive motor from being transmitted to the light receptor.

It will become apparent to those skilled in the art that various modifications to the preferred embodiments of the invention as described herein can be made without departing from the spirit or scope of the invention as defined by the appended claims.

What is claimed is:

1. A method for pacing an image reader at a constant scanning speed comprising:

providing a carriage having a light source lamp traveling along an original on a platen glass, to scan the original with light beams irradiated from the light source lamp;

reading an image formed on the original by detecting light beams reflected from the original and guiding the light beams to a light receptor; and supplying a drive motor for the carriage with a two-phase current for the carriage to travel, which current value can be adjusted at each phase of the two-phase current to provide a constant scanning speed, and wherein the two-phase current is adjusted responsive to a speed fluctuation of the drive motor.

2. A method for pacing an image reader at a constant scanning speed according to claim 1 in which either one current value of the two-phase current is variable to adjust the current value between the two phases.

3. A method for pacing an image reader at a constant scanning speed according to claim 1 and further including detecting speed fluctuations at the drive motor to determine the current values at each phase based on the detected speed fluctuations.

4. A method for pacing an image reader at a constant scanning speed according to claim 2 and further including detecting speed fluctuations at the drive motor to determine the current values at each phase based on the detected speed fluctuations.

5. A method for pacing an image reader at a constant scanning speed comprising:

providing a carriage having a light source lamp traveling along an original on a platen glass, to scan the original with light beams irradiated from the light source lamp;

reading an image formed on the original by detecting light beams reflected from the original and guiding the light beams to a light receptor;

supplying a drive motor for the carriage with a two-phase current for the carriage to travel, which current value can be adjusted at each phase of the two-phase current to provide a constant scanning speed; and running a tentative scan to detect speed fluctuations at the drive motor during the tentative scan to determine the current values at each phase of the two-phase current, based on the detected speed fluctuations, before making a definitive scan to obtain image data.

6. A method for pacing an image reader at a constant scanning speed comprising:

providing a carriage having a light source lamp traveling along an original on a platen glass, to scan the original with light beams irradiated from the light source lamp;

reading an image formed on the original by detecting light beams reflected from the original and guiding the light beams to a light receptor;

supplying a drive motor for the carriage with a two-phase current for the carriage to travel, which current value can be adjusted and either one current value of the two-phase current is variable to adjust the current value between the two phases to provide a constant scanning speed; and running a tentative scan to detect speed fluctuations at the drive motor during the tentative scan to determine the current values at each phase of the two-phase current, based on the detected speed fluctuations, before making a definitive scan to obtain image data.

7. A method for pacing an image reader at a constant scanning speed according to claim 3 wherein the detecting step detects speed fluctuations to determine the current values at each phase of the two-phase current.

8. A method for pacing an image reader at a constant scanning speed according to claim 4 wherein the detecting step detects speed fluctuations to determine the current values at each phase of the two-phase current.

9. A method for pacing an image reader at a constant scanning speed comprising:

providing a carriage having a light source lamp traveling along an original on a platen glass, to scan the original with light beams irradiated from the light source lamp;

reading an image formed on the original by detecting light beams reflected from the original and guiding the light beams to a light receptor;

supplying a drive motor for the carriage with a two-phase current for the carriage to travel, which current value can be adjusted at each phase of the two-phase current to provide a constant scanning speed; and detecting speed fluctuations at the drive motor to determine the current values at each phase based on the detected speed fluctuations, wherein the detecting step detects speed fluctuations at the carriage during a tentative scan to adjust the current value at each phase of the two-phase current, based on the detected speed fluctuations, before making a definitive scan to obtain image data.

10. A method for pacing an image reader at a constant scanning speed comprising:

providing a carriage having a light source lamp traveling along an original on a platen glass, to scan the original with light beams irradiated from the light source lamp;

reading an image formed on the original by detecting light beams reflected from the original and guiding the light beams to a light receptor;

supplying a drive motor for the carriage with a two-phase current for the carriage to travel, which current value can be adjusted and either one current value of the two-phase current is variable to adjust the current value between the two phases to provide a constant scanning speed; and detecting speed fluctuations at the drive motor to determine the current values at each phase based on the detected speed fluctuations, wherein the detecting step detects speed fluctuations at the carriage during a tentative scan to adjust the current value at each phase of the two-phase current, based on the detected speed fluctuations, before making a definitive scan to obtain image data.

11. A device for pacing an image reader at a constant scanning speed of a carriage provided with a light source lamp traveling along an original on a platen glass, while irradiating light beams to scan the original, detecting light beams reflected from the original to guide the light beams to a light receptor to read out an image formed on the original comprising:

an image reader including a drive motor supplied with two-phase current for the carriage; and a drive circuit for adjusting the current value at each phase of the two-phase current to provide a constant carriage speed during a scan, wherein the two-phase current is adjusted responsive to a speed fluctuation of the drive motor.

12. A device for pacing an image reader at a constant scanning speed according to claim 11 and including a motor current detecting resistor at either phase of the drive circuit, wherein at least one of said resistors is a variable resistor and the current value is adjusted by changing the resistance value of said variable resistor.

13. A device for pacing an image reader at a constant scanning speed according to claim 11 and further including a reference voltage source and wherein the two-phase current for the drive motor to work is adjusted in current value by changing the motor current value setting reference voltage supplied on a phase-by-phase basis from a control circuit to the drive circuit.

14. A device for pacing an image reader at a constant scanning speed according to claim 11, further comprising:

a control circuit, wherein the control circuit includes one current value setting reference voltage supplied to the drive circuit coupled to said control circuit and to the respective phases of the drive motor and a voltage divider coupled to said reference voltage in order to adjust the current value at least at either phase of the two-phase current for the drive motor to work by changing the voltage divider.

15. A device for pacing an image reader at a constant scanning speed according to claim 11 including a speed fluctuation detecting means to detect speed fluctuations at the drive motor to change current values at each phase of the two-phase current, based on the speed fluctuations detected by the speed fluctuation detecting means.

16. A device for pacing an image reader at a constant scanning speed according to claim 12 including a speed fluctuation detecting means to detect speed fluctuations at the drive motor to change current values at each phase of the two-phase current, based on the speed fluctuations detected by the speed fluctuation detecting means.

17. A device for pacing an image reader at a constant scanning speed according to claim 13 including a speed fluctuation detecting means to detect speed fluctuations at the drive motor to change current values at each phase of the two-phase current, based on the speed fluctuations detected by the speed fluctuation detecting means.

18. A device for pacing an image reader at a constant scanning speed according to claim 14 including a speed fluctuation detecting means to detect speed fluctuation at the drive motor to change current values at each phase of the two-phase current, based on the speed fluctuations detected by the speed fluctuations detecting means.

19. A device for pacing an image reader at a constant scanning speed of a carriage provided with a light source lamp traveling along an original on a platen glass, while irradiating light beams to scan the original, detecting light beams reflected from the original to guide the light beams to a light receptor to read out an image formed on the original comprising:

an image reader including a drive motor supplied with two-phase current for the carriage;

a drive circuit for adjusting the current value at each phase of the two-phase current to provide a constant carriage speed during a scan; and a motor current detecting resistor at either phase of the drive circuit, wherein at least one of said resistors is a variable resistor and the current value is adjusted by changing the resistance value of said variable resistor, wherein a tentative scan is tried to detect speed fluctuations at the drive motor and to adjust the current value at each phase of the two-phase current, based on the detected speed fluctuations, before a definitive scan to obtain image data is run.

20. A device for pacing an image reader at a constant scanning speed of a carriage provided with a light source lamp traveling along an original on a platen glass, while irradiating light beams to scan the original, detecting light beams reflected from the original to guide the light beams to a light receptor to read out an image formed on the original comprising:

an image reader including a drive motor supplied with two-phase current for the carriage;

a drive circuit for adjusting the current value at each phase of the two-phase current to provide a constant carriage speed during a scan; and a reference voltage source, wherein the two-phase current for the drive motor to work is adjusted in current value by changing the motor current value setting reference voltage supplied on a phase-by-phase basis from a control circuit to the drive circuit, and wherein a tentative scan is tried to detect speed fluctuations at the drive motor and to adjust the current value at each phase of the two-phase current, based on the detected speed fluctuations, before a definitive scan to obtain image data is run.

21. A device for pacing an image reader at a constant scanning speed of a carriage provided with a light source lamp traveling along an original on a platen glass, while irradiating light beams to scan the original, detecting light beams reflected from the original to guide the light beams to a light receptor to read out an image formed on the original comprising:

an image reader including a drive motor supplied with two-phase current for the carriage;

a drive circuit for adjusting the current value at each phase of the two-phase current to provide a constant carriage speed during a scan; and a control circuit which includes one current value setting reference voltage supplied to said drive circuit coupled to said control circuit and to the respective phases of the drive motor and a voltage divider coupled to said reference voltage in order to adjust the current value at least at either phase the two-phase current for the drive motor to work by changing the voltage divider, wherein a tentative scan is tried to detect speed fluctuations at the drive motor and to adjust the current value at each phase of the two-phase current, based on the detected speed fluctuations, before a definitive scan to obtain image data is run.

22. A device for pacing an image reader at a constant scanning speed of a carriage provided with a light source lamp traveling along an original on a platen glass, while irradiating light beams to scan the original, detecting light beams reflected from the original to guide the light beams to a light receptor to read out an image formed on the original comprising:

an image reader including a drive motor supplied with two-phase current for the carriage;

a drive circuit for adjusting the current value at each phase of the two-phase current to provide a constant carriage speed during a scan; and a speed fluctuation detecting means to detect speed fluctuations at the drive motor, wherein a tentative scan is tried to detect speed fluctuations at the drive motor and to adjust the current value at each phase of the two-phase current, based on the detected speed fluctuations, before a definitive scan to obtain image data is run.

23. A device for pacing an image reader at a constant scanning speed of a carriage provided with a light source lamp traveling along an original on a platen glass, while irradiating light beams to scan the original, detecting light beams reflected from the original to guide the light beams to a light receptor to read out an image formed on the original comprising:

an image reader including a drive motor supplied with two-phase current for the carriage;

a drive circuit for adjusting the current value at each phase of the two-phase current to provide a constant carriage speed during a scan; and a test chart, placed on the platen glass or on the underside of the top plate of the housing to avoid any harm in obtaining image data of the original, and a tentative scan is run to obtain image data for measurement from said test chart during the tentative scan, to detect speed fluctuations at the carriage provided with the light source lamp from the image data for measurement, and the current value at each phase of the two-phase current is adjusted based upon the detected speed fluctuations, before a definitive scan to obtain image data is run.

24. A device for pacing an image reader at a constant scanning speed of a carriage provided with a light source lamp traveling along an original on a platen glass, while irradiating light beams to scan the original, detecting light beams reflected from the original to guide the light beams to a light receptor to read out an image formed on the original comprising:

an image reader including a drive motor supplied with two-phase current for the carriage;

a drive circuit for adjusting the current value at each phase of the two-phase current to provide a constant carriage speed during a scan;

a motor current detecting resistor at either phase of the drive circuit, wherein at least one of said resistors is a variable resistor and the current value is adjusted by changing the resistance value of said variable resistor; and a test chart, placed on the platen glass or on the underside of the top plate of the housing to avoid any harm in obtaining image data of the original, and a tentative scan is run to obtain image data for measurement from said test chart during the tentative scan, to detect speed fluctuations at the carriage provided with the light source lamp from the image data for measurement, and the current value at each phase of the two-phase current is adjusted based upon the detected speed fluctuations, before a definitive scan to obtain image data is run.

25. A device for pacing an image reader at a constant scanning speed of a carriage provided with a light source lamp traveling along an original on a platen glass, while irradiating light beams to scan the original, detecting light beams reflected from the original to guide the light beams to the a light receptor to read out an image formed on the original comprising:

an image reader including a drive motor supplied with two-phase current for the carriage;

a drive circuit for adjusting the current value at each phase of the two-phase current to provide a constant carriage speed during a scan;

a reference voltage source, wherein the two-phase current for the drive motor to work is adjusted in current value by changing the motor current value setting reference voltage supplied on a phase-by-phase basis from a control circuit to the drive circuit; and a test chart, placed on the platen glass or on the underside of the top plate of the housing to avoid any harm in obtaining image data of the original, and a tentative scan is run to obtain image data for measurement from said test chart during the tentative scan, to detect speed fluctuations at the carriage provided with the light source lamp from the image data for measurement, and the current value at each phase of the two-phase current is adjusted based upon the detected speed fluctuations, before a definitive scan to obtain image data is run.

26. A device for pacing an image reader at a constant scanning speed of a carriage provided with a light source lamp traveling along an original on a platen glass, while irradiating light beams to scan the original, detecting light beams reflected from the original to guide the light beams to a light receptor to read out an image formed on the original comprising:

an image reader including a drive motor supplied with two-phase current for the carriage;

a drive circuit for adjusting the current value at each phase of the two-phase current to provide a constant carriage speed during a scan;

a control circuit which includes one current value setting reference voltage supplied to the drive circuit coupled to said control circuit and to the respective phases of the drive motor and a voltage divider coupled to said reference voltage in order to adjust the current value at least at either phase of the two-phase current for the drive motor to work by changing the voltage divider; and a test chart, placed on the platen glass or on the underside of the top plate of the housing to avoid any harm in obtaining image data of the original, and a tentative scan is run to obtain image data for measurement from said test chart during the tentative scan, to detect speed fluctuations at the carriage provided with the light source lamp from the image data for measurement, and the current value at each phase of the two-phase current is adjusted based upon the detected speed fluctuations, before a definitive scan to obtain image data is run.

27. A device for pacing an image reader at a constant scanning speed according to claim 11 wherein the drive circuit of the drive motor is installed on a circuit substrate housed inside a cover to cover the light receptor which comprises cooling means to cool the circuit substrate.

28. A device for pacing an image reader at a constant scanning speed according to claim 12 wherein the drive circuit of the drive motor is installed on a circuit substrate housed inside a cover to cover the light receptor which comprises cooling means to cool the circuit substrate.

29. A device for pacing an image reader at a constant scanning speed according to claim 13 wherein the drive circuit of the drive motor is installed on a circuit substrate housed inside a cover to cover the light receptor which comprises cooling means to cool the circuit substrate.

30. A device for pacing an image reader at a constant scanning speed according to claim 14 wherein the drive circuit of the drive motor is installed on a circuit substrate housed inside a cover to cover the light receptor which comprises cooling means to cool the circuit substrate.

31. A device for pacing an image reader at a constant scanning speed according to claim 27 wherein the cooling means comprises at least one ventilation aperture formed on the cover at a part facing the light receptor to ventilate around the light receptor.

32. A device for pacing an image reader at a constant scanning speed according to claim 28 wherein the cooling means comprises at least one ventilation aperture formed on the cover at a part facing the light receptor to ventilate around the light receptor.

33. A device for pacing an image reader at a constant scanning speed according to claim 29 wherein the cooling means comprises at least one ventilation aperture formed on the cover at a part facing the light receptor to ventilate around the light receptor.

34. A device for pacing an image reader at a constant scanning speed according to claim 30 wherein the cooling means comprises at least one ventilation aperture formed on the cover at a part facing the light receptor to ventilate around the light receptor.

35. A device for pacing an image reader at a constant scanning speed according to claim 11 and further including cooling means comprising a drive IC for the drive motor spaced from a drive circuit substrate to assure ventilation between the drive IC and the drive circuit substrate.

36. A device for pacing an image reader at a constant scanning speed according to claim 31 and further including cooling means comprising a drive IC for the drive motor spaced from a drive circuit substrate to assure ventilation between the drive IC and the drive circuit substrate.

37. A device for pacing an image reader at a constant scanning speed according to claim 11 and further including vibration proofing means to prevent vibration at the drive motor from being transmitted to the light receptor.

38. A device for pacing an image reader at a constant scanning speed according to claim 37 wherein said vibration proofing means comprises a fixing screw to fix the cover to cover the light receptor, the fixing screw being fitted within a bushing made of elastic material.

39. A device for pacing an image reader at a constant scanning speed according to claim 37 wherein said vibration proofing means comprises a fixing tongue to fix the fixing screw fixing the cover to cover the light receptor, formed at the tip of an oscillatory supporting arm defined by a pair of slots.

40. A device for pacing an image reader at a constant scanning speed according to claim 37 wherein said vibration proofing means comprises a spindle arranged at some midpoint in transmission path from the drive motor to the light receptor in order to attenuate vibration.

41. A device for pacing an image reader at a constant scanning speed according to claim 38 wherein said vibration proofing means further comprises a spindle arranged at some midpoint in transmission path from the drive motor to the light receptor in order to attenuate vibration.

42. A device for pacing an image reader at a constant scanning speed according to claim 39 wherein said vibration proofing means further comprises a spindle arranged at some midpoint in transmission path from the drive motor to the light receptor in order to attenuate vibration.

* * * * *

UNITED STATES PATENT AND TRADEMARK OFFICE

CERTIFICATE OF CORRECTION

PATENT NO. : 6,892,043 B2
APPLICATION NO. : 10/616318
DATED : May 10, 2005
INVENTOR(S) : Hayashi et al.

It is certified that error appears in the above-identified patent and that said Letters Patent is hereby corrected as shown below:

Column 2, line 31, “phases” should be --phase--.
Column 4, line 20, delete “a”.
Column 8, line 55, “42b” should be --41b--.
Column 9, line 37, “400% in Fig. 8” should be --400% in Fig. 9--.
Column 18, line 8, “fluctuations” should be --fluctuation--.
Column 19, line 3, after “phase” insert --of--.

Signed and Sealed this

Twentieth Day of November, 2007

JON W. DUDAS
*Director of the United States Patent and Trademark Office*